US005988784A

United States Patent [19]

Takemura et al.

[11] Patent Number: 5,988,784

[45] Date of Patent: Nov. 23, 1999

[54] METHOD AND APPARATUS FOR RECORDING INFORMATION WITH CORRECTED DRIVE TIMING

[75] Inventors: Makoto Takemura, Tokyo; Shinji Kanemitsu; Makoto Kashimura, both of Yokohama; Shinya Matsui, Tokyo; Toshiyuki Onishi; Tetsuhiro Nitta, both of Yokohama; Yasuhiro Unosawa, Tokyo; Hajime Yoshida; Masaru Satou, both of Yokohama; Hisashi Morioka, Kawagoe; Hiroshi Yoshino, Yokohama, all of Japan

[73] Assignee: Canon Kabushiki Kaisha, Tokyo, Japan

[21] Appl. No.: 08/149,747

[22] Filed: Nov. 10, 1993

[30] Foreign Application Priority Data

| | | | |
|---|---|---|---|
| Nov. 12, 1992 | [JP] | Japan | 4-302152 |
| Dec. 24, 1992 | [JP] | Japan | 4-343834 |

[51] Int. Cl.[6] ..... B41J 25/308

[52] U.S. Cl. ..... 347/8; 347/14; 347/37

[58] Field of Search ..... 347/8, 14, 37; 400/56, 57, 323, 322; 346/139 R

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,345,263 | 8/1982 | Tazaki et al. | 347/37 |
| 4,459,600 | 7/1984 | Sato et al. | 346/140 R |
| 4,463,359 | 7/1984 | Ayata et al. | 346/1.1 |
| 4,515,487 | 5/1985 | Minami | 400/124 |
| 4,558,333 | 12/1985 | Sugitani et al. | 346/140 R |
| 4,608,577 | 8/1986 | Hori | 346/140 R |
| 4,652,153 | 3/1987 | Kotsuzumi et al. | 400/56 |
| 4,723,129 | 2/1988 | Endo et al. | 346/1.1 |
| 4,731,542 | 3/1988 | Doggett | 250/548 |
| 4,740,796 | 4/1988 | Endo et al. | 346/1.1 |

(List continued on next page.)

FOREIGN PATENT DOCUMENTS

| | | | |
|---|---|---|---|
| 54-56847 | 5/1979 | Japan . | |
| 56-89976 | 7/1981 | Japan | 400/323 |
| 59-123670 | 7/1984 | Japan . | |
| 59-138461 | 8/1984 | Japan . | |
| 60-71260 | 4/1985 | Japan . | |
| 63-5977 | 1/1988 | Japan | 400/323 |
| 1-247179 | 10/1989 | Japan | 400/323 |
| 2-204043 | 8/1990 | Japan | 347/8 |

*Primary Examiner*—N. Le
*Assistant Examiner*—Hai C. Pham
*Attorney, Agent, or Firm*—Fitzpatrick, Cella, Harper & Scinto

[57] ABSTRACT

Ink jet recording encounters deviations in the position at which a recorded dot is applied due to changes in the distance from the recording head to a recording medium, the carriage movement speed and the ink discharge speed or the like. When bidirectional recording is performed while moving the carriage having the recording head mounted thereon, deviations of the recorded dot may occur in the forward and rearward recording operations. The present invention is arranged in such a manner that values for correcting the deviations occurring in bidirectional recording and corresponding to the changes of the distance from the recording head to a recording medium, the carriage movement speed and the ink discharge speed or the like are previously stored. A drive signal, the timing of which has been corrected with the correction value, is used to operate the apparatus so that high-quality recordings free from deviations occurring in the bidirectional recording operation are obtained. The present invention disclosed a recording apparatus having a plurality of recording heads mounted on a carriage thereof, the recording apparatus being arranged in such a manner that the carriage movement speed is detected to determine the recording timing of the plural recording heads to prevent the deviation of dots formed by the plural recording heads due to the changes in the moving speed caused by changes in the environment of the apparatus to record high quality images.

45 Claims, 21 Drawing Sheets

U.S. PATENT DOCUMENTS

| | | | |
|---|---|---|---|
| 4,789,874 | 12/1988 | Majette et al. | 347/37 |
| 4,818,129 | 4/1989 | Tanuma et al. | 400/323 |
| 4,881,835 | 11/1989 | Niikawa | 400/56 |
| 5,138,342 | 8/1992 | Kurata et al. | 346/140 R |
| 5,156,464 | 10/1992 | Sakai | 400/56 |
| 5,172,142 | 12/1992 | Watanabe et al. | 347/14 |
| 5,245,361 | 9/1993 | Kashimura et al. | 346/140 R |
| 5,245,364 | 9/1993 | Uchida et al. | 347/8 X |

FIG. 8

○ $V_{d1}$

| $V_{crj}$ \ $L_k$ | k = 1 | k = 2 | ····· | k = p |
|---|---|---|---|---|
| j = 1 | $\Delta X_{1\cdot1\cdot1}$ | $\Delta X_{1\cdot1\cdot2}$ | ····· | $\Delta X_{1\cdot1\cdot p}$ |
| j = 2 | $\Delta X_{1\cdot2\cdot1}$ | $\Delta X_{1\cdot2\cdot2}$ | ····· | $\Delta X_{1\cdot2\cdot p}$ |
| ⋮ | ⋮ | ⋮ | | ⋮ |
| j = n | $\Delta X_{1\cdot n\cdot1}$ | $\Delta X_{1\cdot n\cdot2}$ | ····· | $\Delta X_{1\cdot n\cdot p}$ |

○ $V_{dm}$

| $V_{crj}$ \ $L_k$ | k = 1 | k = 2 | ····· | k = p |
|---|---|---|---|---|
| j = 1 | $\Delta X_{m\cdot1\cdot1}$ | $\Delta X_{m\cdot1\cdot2}$ | ····· | $\Delta X_{m\cdot1\cdot p}$ |
| j = 2 | $\Delta X_{m\cdot2\cdot1}$ | $\Delta X_{m\cdot2\cdot2}$ | ····· | $\Delta X_{m\cdot2\cdot p}$ |
| ⋮ | ⋮ | ⋮ | | ⋮ |
| j = n | $\Delta X_{m\cdot n\cdot1}$ | $\Delta X_{m\cdot n\cdot2}$ | ····· | $\Delta X_{m\cdot n\cdot p}$ |

METHOD AND APPARATUS FOR RECORDING INFORMATION WITH CORRECTED DRIVE TIMING

BACKGROUND OF THE INVENTION

1. Field of the Invention

The present invention relates to technology to prevent deviation of dots occurring with a recording apparatus, and more particularly to a technology to prevent deviation of dots occurring in a bidirectional recording operation performed by an ink jet recording apparatus.

2. Description of the Related Art

Hitherto, a recording apparatus for recording information on a recording medium, such as paper or an OHP sheet, has been suggested while being formed into a shape having a recording head mounted thereon, the recording head being adapted to any one of various recording methods such as a wire dot recording method, a thermal recording method, an ink jet recording method or the like.

A typical recording apparatus employs a serial printer. The serial printer records or prints (hereinafter called "records") data while moving a carriage having a recording (printing) head mounted thereon with respect to the recording medium. An example of the conventional structure of the foregoing type is shown in FIG. 16. FIG. 16 is a perspective view which illustrates a conventional recording apparatus.

As shown in FIG. 16, a recording head 1002 is fastened to a carriage 1001. While allowing the carriage 1001 to reciprocate in parallel to a platen 1003 (in directions designated by arrows a and b shown in FIG. 16), a recording medium 1004 is conveyed for one line (in a direction designated by an arrow c shown in FIG. 16) so that data items on the ensuing lines are recorded by the recording head 1002. In this case, ink is discharged from the recording head 1002 only when the head moves in the direction designated by the arrow b shown in FIG. 16.

As for the recording medium, it is an important fact that data can be recorded onto both a thick sheet, such as an OHP film, a post card, and an envelope, as well as the usual copying paper. From the foregoing viewpoints, the structure of the recording apparatus has been arranged in such a manner that the distance from the recording head to the recording medium can be varied.

As described above, the conventional recording apparatus must simplify the elements constituting the recording apparatus and mechanisms that respectively connect the elements to one another, reduce the size of the apparatus, and increase the recording speed.

In contrast to the foregoing recording method in which the recording operation is performed in only the single direction, bidirectional recording in which the recording operation is performed when the carriage is returned as well offers an advantage in terms of increasing recording speed. Therefore, the bidirectional recording must be performed to raise the operational speed of the recording apparatus. However, when that is done, the direction in which the carriage employed in the ink jet recording method for recording data by discharging ink is moved in one direction in the forward recording operation and in the other direction for the rearward recording operation. Therefore, it has been known that the recording operation involves a deviation in principle. Further, the quantity of the deviation varies depending upon the distance from the recording head to the recording medium.

FIG. 17 is a schematic view which illustrates a state where ink is discharged from a recording head of an ink jet recording apparatus to a recording medium.

In FIG. 17, Vd is ink droplet discharge speed and Vcr is the moving speed of the carriage, the direction of the movement of the carriage being reversed between the forward movement and the rearward movement. Symbol L denotes the distance from the recording head to the recording medium.

The ink droplet discharged at a specific time shown in FIG. 17 has a speed component V obtained by synthesizing Vd and Vcr at the time at which the discharge is performed. The ink droplet reaches the recording medium (L/Vd) seconds after the discharge. At this time, the ink droplet reaches a position shifted in direction x by a quantity expressed by Vcr×(L/Vd). Although the position at which the ink droplet is received by the recording medium is deviated whenever one line is recorded, the deviation cannot be recognized in the final product of the one-directional recording process because the shifts are performed by the same amount in the same direction for each line.

On the contrary, in bidirectional recording the recording operation is performed during both forward and rearward movement of the carriage, the direction of the carriage movement at a moving speed of Vcr being reversed between the forward and the rearward movements. Therefore, the position at which the ink droplet is received deviates for each line by a quantity expressed by 2×Vcr×(L/Vd). There arises a problem to be solved so as to improve the quantity of the recorded product.

A recording apparatus comprising a plurality of recording means disposed to be adaptable to different-color recording materials, such as ink, and mounted on a carriage thereof and arranged for moving the recording means in a predetermined direction with respect to a recording medium, such as recording paper, an OHP film or a cloth sheet to record data by superposing colors suffers from a problem in that slight deviations take place in the superposition of the colored dots in the moving direction. In particular, the desired multi-color images cannot be obtained due to the undesirable effect on the superposition of the colors. In order to prevent color deviations from occurring in the moving direction, a structure has been employed which is arranged in such a manner that a test pattern is recorded at the time of the assembly or the adjustment of the recording apparatus. Further, the recorded dot superposition of the colors is used to adjust precisely the position of recording means with respect to a standard recording means to fix the recording means.

As another method of preventing color deviations in the head moving direction, a structure has been employed in which the recording means is fixed to a predetermined position, and the timing at which the other recording means perform recording is adjusted with respect to the recording timing of the standard recording means in accordance with the degree of the color deviation.

However, even if the dot deviations occurring among the recording means can be completely adjusted at the time of the assembly or the adjustment, the relative movement speed is later changed due to expansion or contraction of the means, for example, the carriage, that causes the foregoing relative movement should the environment of the recording apparatus be changed, and more particularly if the temperature is changed. In this case the dots deviate because of changes in the relative movement speed.

The foregoing problem will now be described with reference to FIG. 18. The apparatus shown in FIG. 18 comprises a carriage 1102 on which ink jet heads 1101A, 1101B, 1101C and 1101D corresponding to four colors (for example, yellow, magenta, cyan and black) ink are mounted.

The carriage 1102 is caused to reciprocate along a guide rail 1107 in the lateral direction by the operating force transmitted from a motor 1103 for moving the carriage 1102 so that data is recorded on recording paper sheet 1108. The operating force generated by the motor 1103 is transmitted to the carriage 1102 by way of a wire 1109 arranged between a motor pulley 1104 and an idler pulley 1105, the wire 1109 being fixed at a fixing portion 1102*a* of the carriage 1102.

Assuming that the ink jet heads 1101A to 1101D are equally mounted on the carriage 1102 at pitch L and data is recorded when the carriage 1102 is moved at speed V to the right portion of FIG. 18, data can be recorded on the same point by the standard ink jet head 1101A and the ink jet head 1101B when the ink jet head 1101B performs the recording operation $\Delta T_2=L/V$ after the moment at which the standard ink jet head 1101A has performed the recording operation. Further, the residual ink jet heads 1101C and 1101D must perform the recording operations $\Delta T_2=2L/V$ and $\Delta T_3=3L/V$ after the ink jet head 1101A has performed the recording operation. If V=300 mm/sec and L=30 mm, the following requirements arise: $\Delta T_1=0.1$ sec, $\Delta T_2=0.2$ sec and $\Delta T_3=0.3$ sec. If the rotational speed of the motor 1103 is 300 rpm, the diameter of the motor pulley 1104 will be about 18 mm (if the diameter of the wire is 1 mm). However, somewhat deviations of V and L from the designed values due to manufacturing errors or the like raise the necessity of further allowing electrical adjustment of the recording timing adjustment quantity $\Delta T_1$ to $\Delta T_3$ to be performed at the time of the assembly or the adjustment of the recording apparatus to correct the recorded dot.

Even if the deviation of the recorded dots to be superposed is corrected at the time of assembly or adjustment of the apparatus, differences in the environment in which the apparatus is used will cause motor pulley 104 to expand or contract. In this case, the recorded dots desired to be superposed are sometimes deviated. An example of that case will now be described in which a recording apparatus having the foregoing dimensions has been adjusted at 28° C. and it is used at 13° C., that is a temperature difference of 15° C. takes place. If the motor pulley is made of polyacetal having a linear expansion coefficient of about 8 to $11\times10^{-5}$ 1/° C. the diameter of the pulley changes by 27 $\mu$m for the case where it is assumed that the expansion coefficient is $10\times10^{-5}$. If the recording apparatus is operated in the foregoing state, the speed V is 300×(18−0.027)/18=299.55 (mm/sec).

Considering the recording state, the head 1101B forms a dot at a position in front of the dot formed by the ink jet head 1101A by 30−(299.55×0.1)=0.045 (mm). Similarly, the ink jet heads 1101C and 1101D form dots at positions in front of the same by 0.090 mm and 0.135 mm, respectively. As a result, the recorded dots are deviated as described above. Since a 360 DPI (dots/inch) or a 400 DPI head, the image density of which is raised, has a narrow dot pitch of 0.0706 mm or 0.0635 mm, the foregoing deviation is larger than the dot pitch and so there arises a critical problem because the color of the recorded product can be changed considerably. Even if a timing belt is used as the transmission means in place of the wire, a similar problem arises although the influence upon the speed can be eliminated satisfactorily. What is worse, another problem arises when another timing belt is used in place of a broken timing belt in that scattering of the length of the timing belt arises the undesirable difference in the drive speed. Therefore, the deviation of the recorded dot must be adjusted again, requiring the complicated adjustment operation to be performed.

SUMMARY OF THE INVENTION

The present invention is directed to the use of a variety of recording mediums while minimizing deviations if dots are recorded when there is bidirectional movement of the carriage, and therefore an object of the present invention is to provide an ink jet recording apparatus which is capable of providing excellent recordings, which can be used easily and which is able to record data at high speed.

In order to achieve the foregoing objects, according one aspect of the present invention, there is provided a recording apparatus that uses a recording head for recording data on a recording medium by discharging ink, and this recording apparatus includes a carriage on which the recording head is mounted, moving means for causing the carriage to reciprocate with respect to the recording medium with a forward directional relative movement and a rearward directional relative movement, and recording control means that operates the recording head during a moving operation performed by the moving means to record data on the recording medium. Setting changing means are provided for changing the setting of at least any one of a distance from the recording head to the recording medium, a speed at which the carriage is relatively moved by the moving means and an ink discharge speed from the recording head. Further aspects of this invention also include either a detection means for detecting at least any one of a distance from the recording head to the recording medium, a speed at which the carriage is relatively moved by the moving means and an ink discharge speed from the recording head, or a mode selection means for selecting a recording mode corresponding to a distance from the recording head to the recording medium. All of these aspects of this invention have a storage means in which a correction value for correcting a deviation occurring in a recording operation between a forward moving operation of the carriage and a rearward moving operation of the carriage is stored to correspond to each condition set by the setting changing means. Selection means selects a given correction value from the storage means, the given correction value corresponding to a plurality of set conditions set by the setting changing means, and a head drive means corrects a recording timing of the recording head in accordance with the given correction value selected by the selection means and operates the recording head.

A further aspect of the present invention is a recording method in which a recording head for recording data on a recording medium by discharging ink is mounted on a carriage and the recording head is operated during a moving operation in which the carriage is relatively reciprocated in a forward recording operation and a rearward recording operation with respect to the recording medium. This method involves setting at least any one of a distance from the recording head to the recording medium, a speed at which the carriage is relatively moved by the moving means and an ink discharge speed from the recording head is changed, a correction value determining step in which a correction value for correcting a deviation occurring in a recording operation between a forward moving operation of the carriage and a rearward moving operation of the carriage is determined to correspond to the changed condition set by the setting changing means, and a step in which the recording timing of the recording head is corrected in accordance with the correction value and the recording head is operated in accordance with the recording timing to record data on the recording medium.

Still another aspect of this invention is a recording method in which a recording head for recording data on a recording medium by discharging ink is mounted on a carriage sand the recording head is operated during a moving operation in which the carriage is relatively reciprocated with respect to the recording medium. This recording method involves a mode selection step in which a recording mode corresponding to a distance from the recording head to the recording medium is selected, a step in which a correction value for correcting a deviation occurring in a recording operation between a forward moving operation of the carriage and a rearward moving operation of the carriage is determined to correspond to the recording mode selected in the mode selection step, and a step in which a recording timing of the recording head is corrected in accordance with the correction value and the recording head is operated in accordance with the recording timing to record the data on the recording medium.

Additionally, this invention concerns a recording apparatus that includes a carriage on which plural recording means which record data on a recording medium and which are disposed in a predetermined direction can be mounted, moving means for moving the carriage with respect to the recording medium in the predetermined direction in a relative moving operation with a relative movement and speed, recording control means that operates the plural recording means during the relative moving operation performed by the moving means to record the data on the recording medium, speed detection means for detecting a speed of the relative movement performed by the moving means, and mean for determining an operation timing of the plural recording means in accordance with a result of the speed detection performed by the speed detection means.

Furthermore, this invention relates to a recording apparatus having a recording head which discharges ink to record data on a recording medium, and this recording apparatus includes a carriage on which the recording head is mounted, moving means for moving the carriage with respect to the recording medium, recording control means that operates the recording head during movement of the carriage caused by the moving means to record the data on the recording medium, and recording timing setting means for setting recording timing to correspond to a distance from the recording head to the recording medium. Head drive means are provided for driving the recording head in accordance with the recording timing set by the recording timing setting means.

Other and further objects, features and advantages of the invention will be appear more fully from the following description.

BRIEF DESCRIPTION OF THE DRAWINGS

FIG. 8 illustrates a correction table;

DESCRIPTION OF THE PREFERRED EMBODIMENTS

Preferred embodiments of the present invention will now be described with reference to the drawings.

First Embodiment

An ink jet recording apparatus according to a first embodiment of the present invention will now be described with reference to FIGS. 1 and 2.

Figure 1:
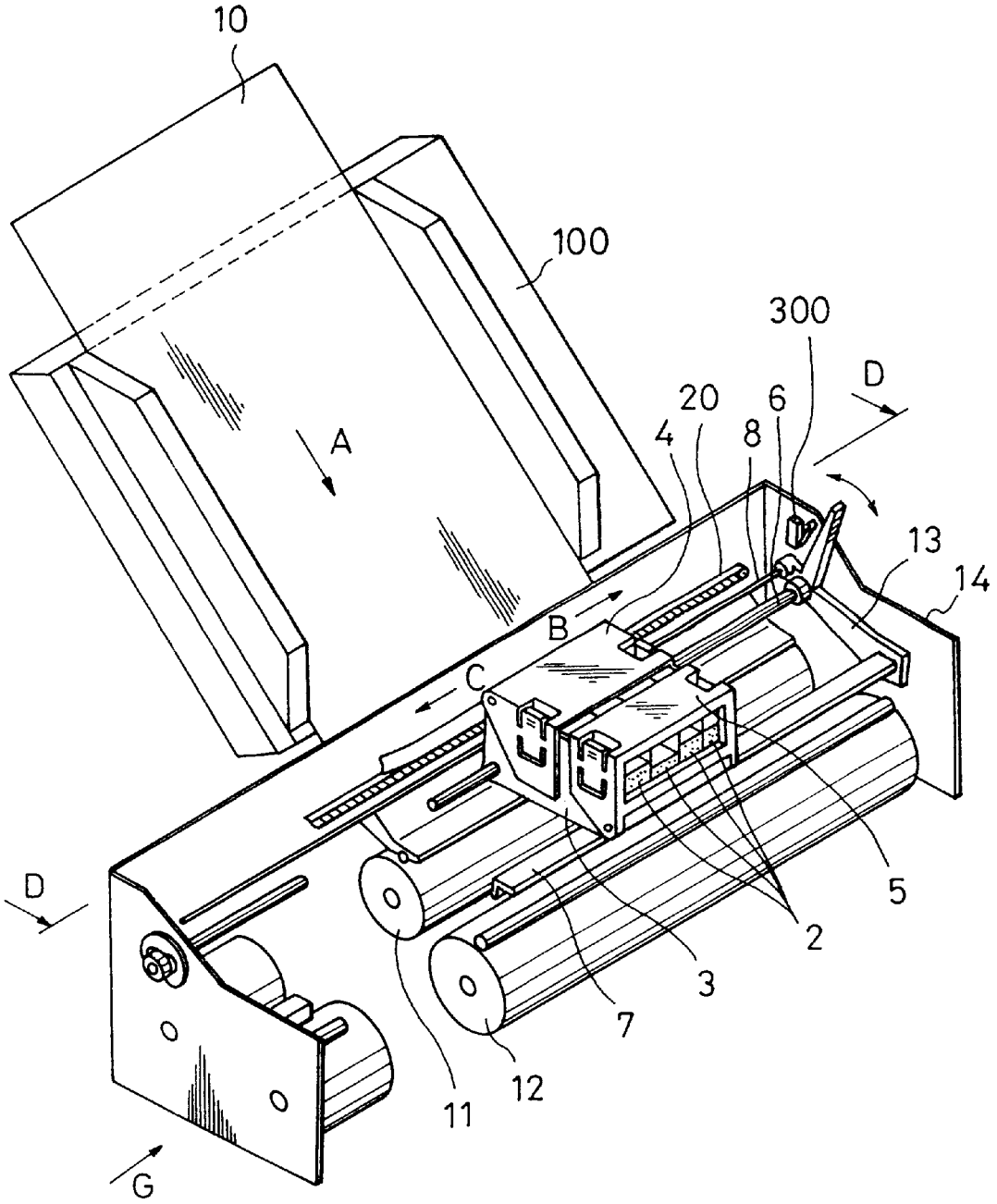
FIG. 1 is a perspective view which illustrates an ink jet recording apparatus.

FIG. 1 is a perspective view which illustrates the ink jet recording apparatus. FIG. 2 is a perspective view which illustrates a carriage portion of the ink jet recording apparatus.

Referring to FIG. 1, reference numeral 10 represents a recording medium mounted on a conveyance mounting means 100. The recording medium 10 is supplied to a conveyance means 11 by a paper supply means operated by a drive source (omitted from illustration), the recording medium 10 being then conveyed in a direction designated by an arrow A shown in FIG. 1 by way of a paper discharge means 12. Reference numeral 3 represents a carriage that supports a recording head and ink cartridges 2 (four ink cartridges are mounted in this embodiment), the carriage being moved in directions respectively designated by arrows B and C by a drive source (not shown), such as a motor, while interposing a belt 20. A head cover 4 and a cartridge cover 5, that secure the recording head and the ink cartridge 2 to the carriage 3, are rotatively and detachably disposed on the carriage 3. Reference numeral 21 (see FIG. 2) represents a cable for transmitting a drive signal to the recording head mounted on the carriage 3. Reference numeral 6 represents a guide shaft for enabling the carriage 3 to be moved. Reference numeral 7 represents a support surface that supports and guides an end of the carriage 3. Reference numeral 8 represents a linear scale extending in the direction in which the carriage 3 is moved.

Figure 2:
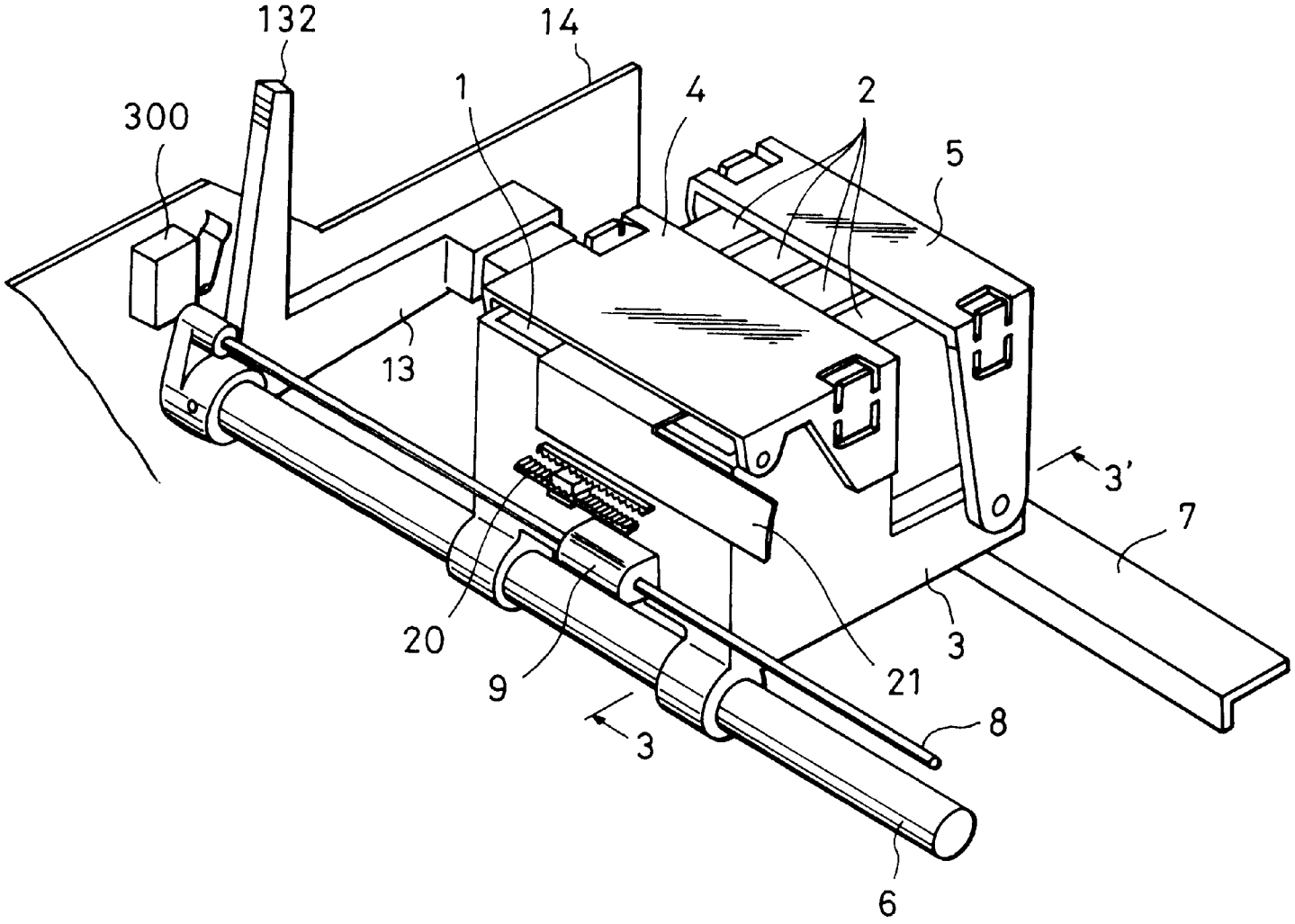
FIG. 2 is a perspective view which illustrates a carriage portion of the ink jet recording apparatus.

FIG. 2 is a perspective view which illustrates the carriage 3 when viewed from a direction designated by an arrow D—D shown in FIG. 1, wherein the relationship between the linear scale 8 and a reading device 9 is illustrated in detail. Referring to FIG. 2, reference numeral 1 represents a recording head so structured as to form an image by forming fluid droplets of a recording solution by making use of heat energy, the recording head 1 being connected to the ink cartridge 2 by an ink passage. The reading device 9 for obtaining a synchronizing signal is fastened to the carriage 3. In the first embodiment, the reading device 9 is adapted to use a magnetic reading method that uses an MR (magnetic rheostat) device or the like. The linear scale 8 is a magnetic member formed into a rod shape having a magnetized portion formed on the surface thereof, the magnetized portion being a portion in which a magnetic pattern is recorded at a recording pitch density corresponding to, for example, 180 dots/inch (dpi) or 360 dpi. Since the linear scale 8 and the reading device 9 are associated with each other as described above, the position detection can be enabled when the carriage 3 is moved.

The ink jet recording apparatus shown in FIG. 1 provides a control structure that performs the recording operation at a drive timing of the recording head 1 established in synchronization with the result of the foregoing detection. In particular, the fact that magnetization at a pitch corresponding to about 360 dpi to 600 dpi can be realized in the magnetic reading method enables the foregoing ink jet recording apparatus to be employed as a recording apparatus capable of recording data precisely.

The end portions of each of the guide shaft 6, the support surface 7 and the linear scale 8 are disposed at the two terminative ends of a frame 14 and are supported by supporting members 13. The supporting members 13 have support points of rotation that engage with the frame 14 as to be rotated in the space of the frame 14. Reference numeral 132 represents an operation lever portion extending from the support members 13. Reference numeral 300 represents a micro-switch fixed to the frame 14, the micro-switch 300 being so disposed as to be switched on/off in accordance with the position of the lever 132.

Figure 3:
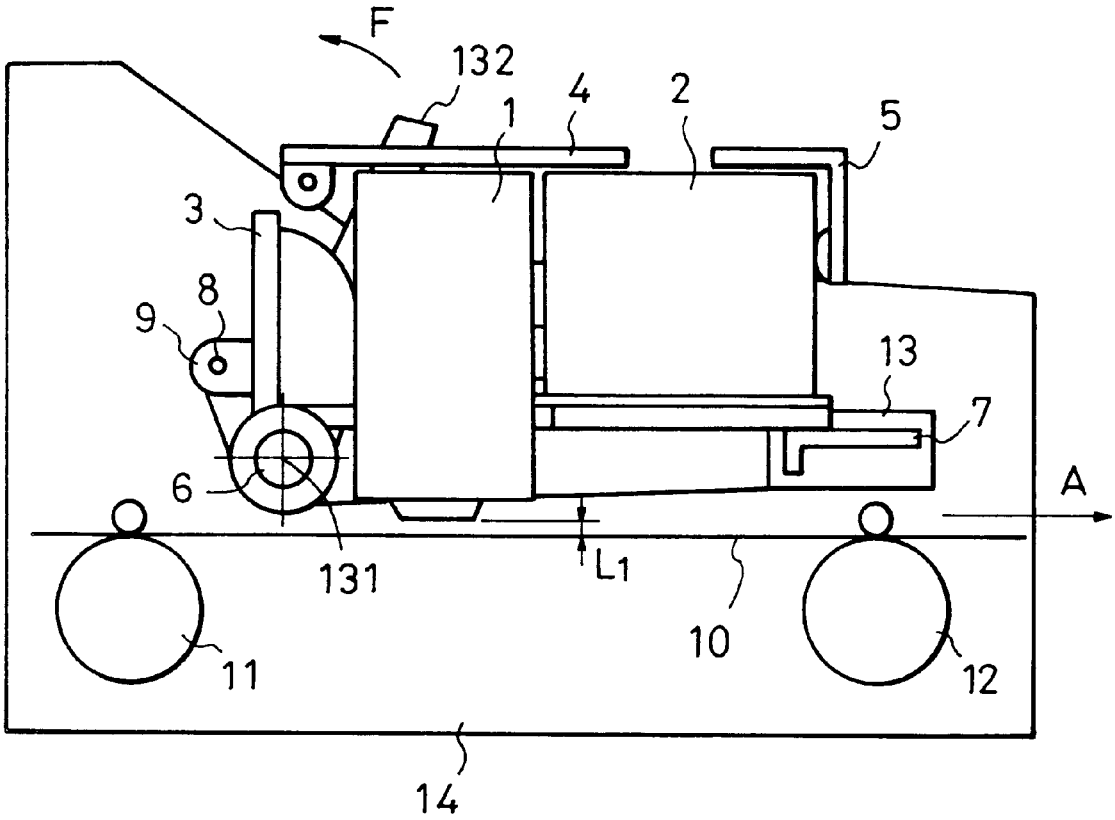
FIG. 3 is a side elevational cross sectional view which illustrates the carriage portion of the ink jet recording apparatus.
Figure 4:
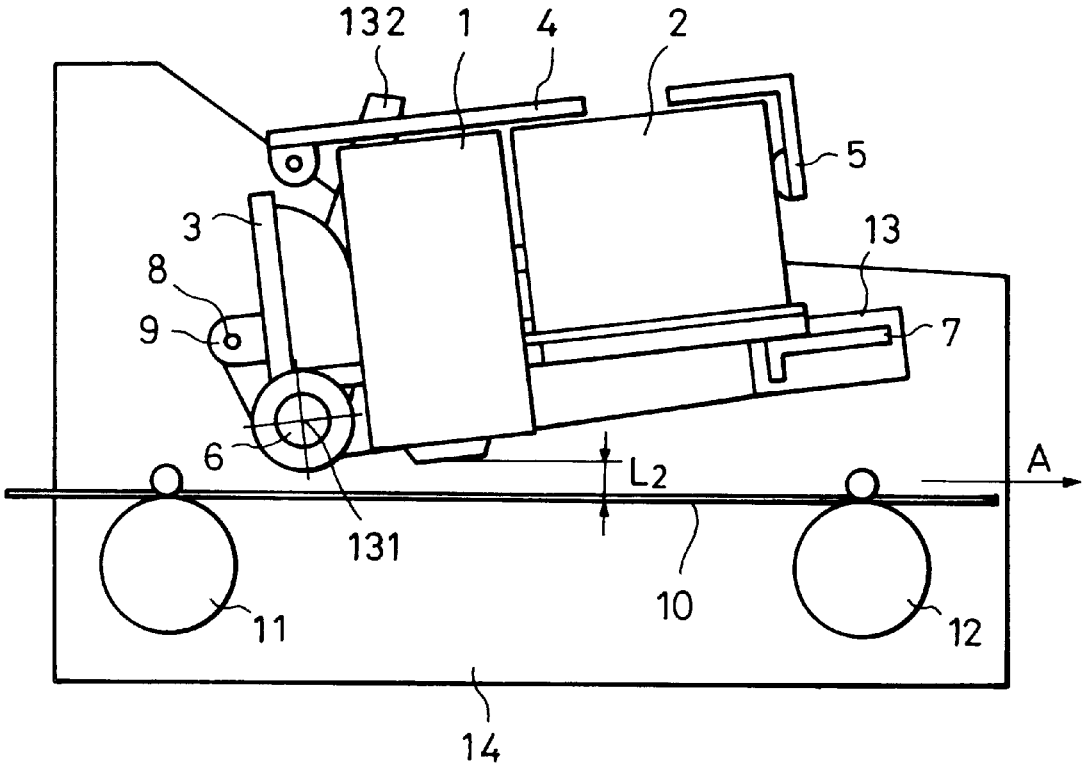
FIG. 4 is a side elevational cross sectional view which illustrates the carriage portion of the ink jet recording apparatus.

The operation of the first embodiment will now be described with reference to FIGS. 3 and 4. FIGS. 3 and 4 are side cross-sectional view taken along a line designated by an arrow 3–3' of FIG. 2, wherein respective states are illustrated in which setting of the lever portion 132 is varied.

Referring to FIG. 3, when the carriage 3 commences movement in a direction perpendicular to the surface of the paper, the reading device 9 secured to the carriage 3 is moved relatively on the linear scale 8 secured to the frame 14 while interposing the support member 13. As a result, a position signal is generated, and a recording head recording signal synchronized with the position signal is generated. By transmitting the recording head recording signal to the recording head 1, the recording head 1 is operated so that an ink droplet is discharged to the surface of the recording medium 10. As a result, the position of the carriage 3 and the result of the recording operation can completely be synchronized.

Referring to FIG. 3, the recording medium 10 is a paper sheet of the usual thickness. The distance from the recording medium 10 to the recording head 1 is expressed by value L1. If an operator intends to record data on a thicker recording medium, the user rotates the lever portion 132 in a direction designated by an arrow F shown in FIG. 3. As a result, the overall body of the supporting member 13 is rotated, causing the recording head 1 and the carriage 3 to be rotated as to be moved away. Therefore, the predetermined distance L2 from the thick recording medium can be maintained. The distance L2 is longer than L1 shown in FIG. 3. In this embodiment, an assumption is made that data is recorded on a recording medium, such as an envelope, which is considerably thicker than the usual paper sheet.

Figure 5:
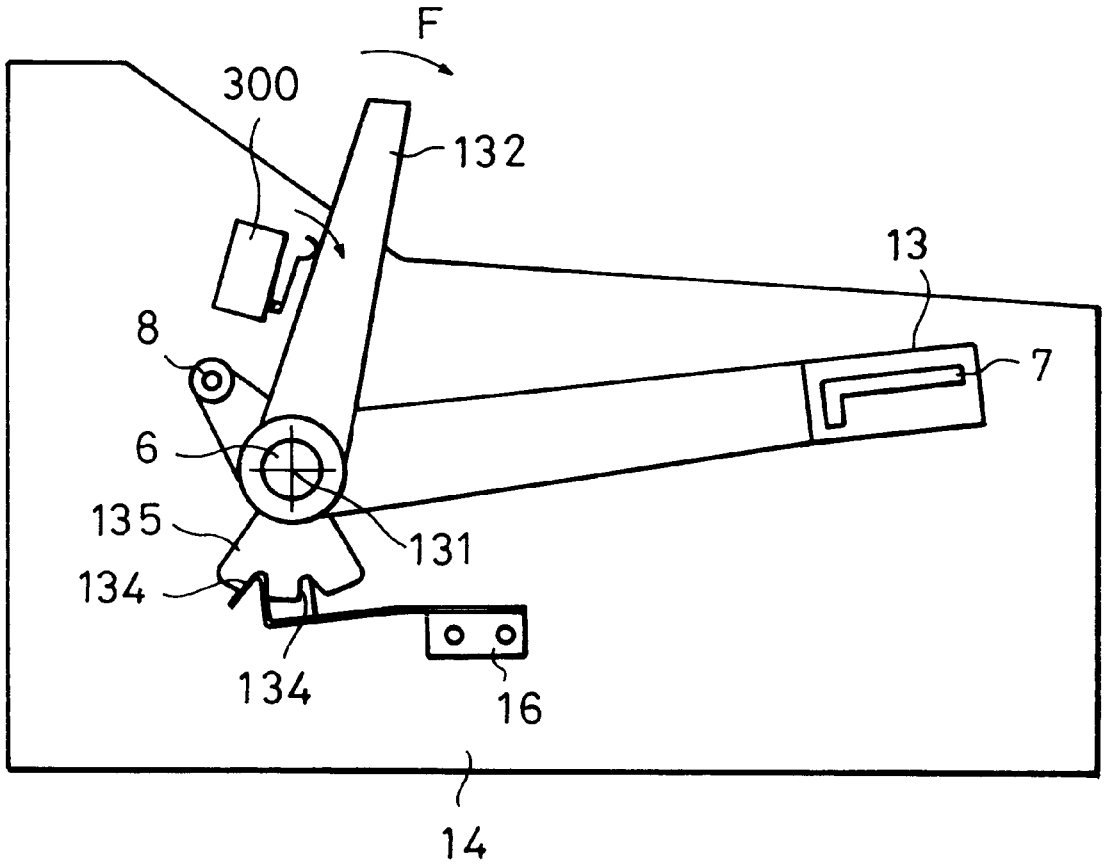
FIG. 5 is a side elevational cross sectional view which illustrates support members.

FIG. 5 illustrates a state where the lever portion 132 is located to be adaptable to the thick paper sheet. As shown in FIG. 5, a cam portion 135 is formed integrally with the support member 13, the supporting member 13 having adequately number recessed grooves 134 that are engaged to the end portion of a latch member 16 made of elastic material. As a result, the position, to which the support member 13 is brought due to rotation, is determined. Further, the micro-switch 300 is in a state where it is depressed by an end of the lever 132 so that the micro-switch 300 is switched on in the foregoing state.

When the lever 132 is given adequate force in a direction designated by an arrow F, the elastic force of the latch member 16 is overcome and the lever 132 starts rotating gradually. In accordance with the foregoing operation, the state, in which the micro-switch 300 is depressed, is cancelled so that the micro-switch 300 is switched off. FIG. 3 illustrates a state where the cam member shown in FIG. 5 has completed the rotation by a predetermined quantity, the latch member 16 has been again engaged with the recessed groove 134 and the position after the rotation is fixed. In the foregoing state, the micro-switch 300 is switched off.

When the lever portion 132 is rotated, the guide shaft 6, the support surface 7 and the linear scale 8 are integrally rotated around a rotation center 131 by the support members 13 disposed at the two ends. Therefore, the relative positional relationship among the three elements is not changed, so that the positional relationship between the linear scale 8 and the reading device 9 can be maintained. Therefore, the position signal denoting the position of the carriage 3 can always be detected at the same output level regardless of the thickness of the recording medium. As a result, the position of the carriage 3 can assuredly be controlled.

Figure 6:
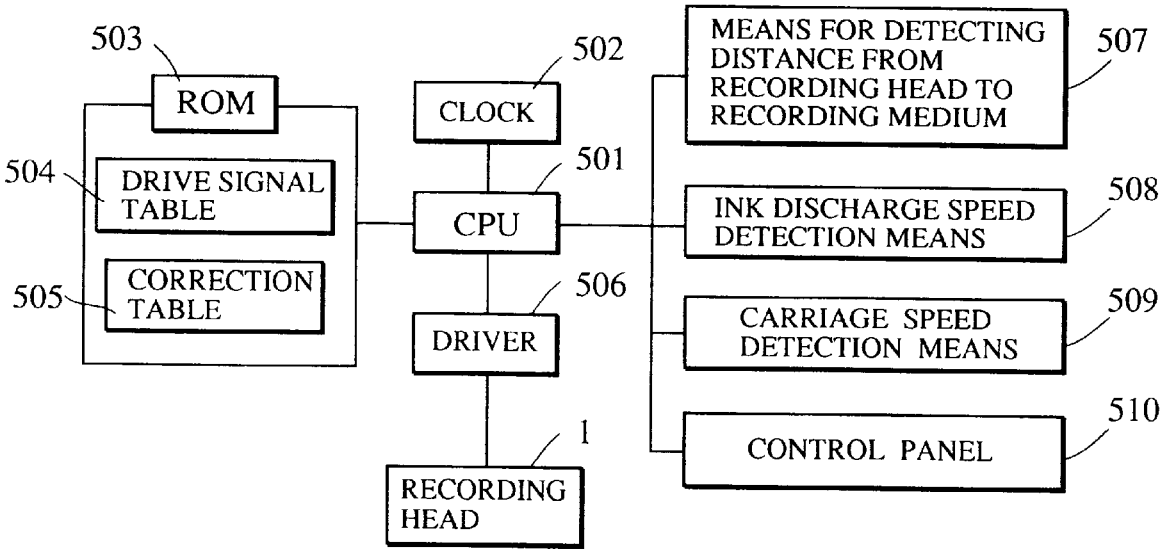
FIG. 6 is a block diagram which illustrates a control system of the ink jet recording apparatus.

FIG. 6 is a block diagram which illustrates the structure of a control system according to the first embodiment.

Referring to FIG. 6, reference numeral 501 represents a central processing unit (hereinafter called a "CPU") for controlling the overall operation of the ink jet recording apparatus. Reference numeral 502 represents a clock for defining the timing signal at a predetermined period, and 503 represents a storage means (hereinafter called a "ROM") that stores a drive signal table 504 for operating the recording head 1 by a variety of control methods and a correction table 505 containing the quantity of correction of deviation in the bidirectional recording operation. The drive signal table 504 stores, for example, data about the distance (for example, the timing that determines the position at which printing of data on the recording medium is commenced) from the reading device for generating a carriage position signal to the discharge nozzle of the recording head 1 in the moving direction, data (for example, the timing for controlling the dot position for superposing ink droplets discharged from the plural heads on the recording medium for example) about the arrangement pitch of the heads in the moving direction, if the recording head is composed of a plurality of heads, the value of voltage applied for driving the recording head, and data about the printing time (for example, the speed at which the ink droplet is discharged is changed over by changing the voltage applied and the application duration).

The correction table 505 will be described later together with the description of the relevant procedure.

Reference numeral 506 represents a driver for driving the recording head 1, and 507 represents a means for detecting the distance from the recording head to the recording medium (although the micro-switch 300 is employed in this embodiment, a slidable contact that comes in contact with the surface of the recording medium may be mounted on the carriage 3 to measure directly the distance). Reference numeral 508 represents an ink discharge speed detection means, 509 represents a carriage speed detection means, and 510 represents a control panel that can be operated by an operator. The foregoing various control methods are methods for controlling the distance from the recording head to the recording medium, the ink discharge speed and the carriage movement speed.

Figure 7A:
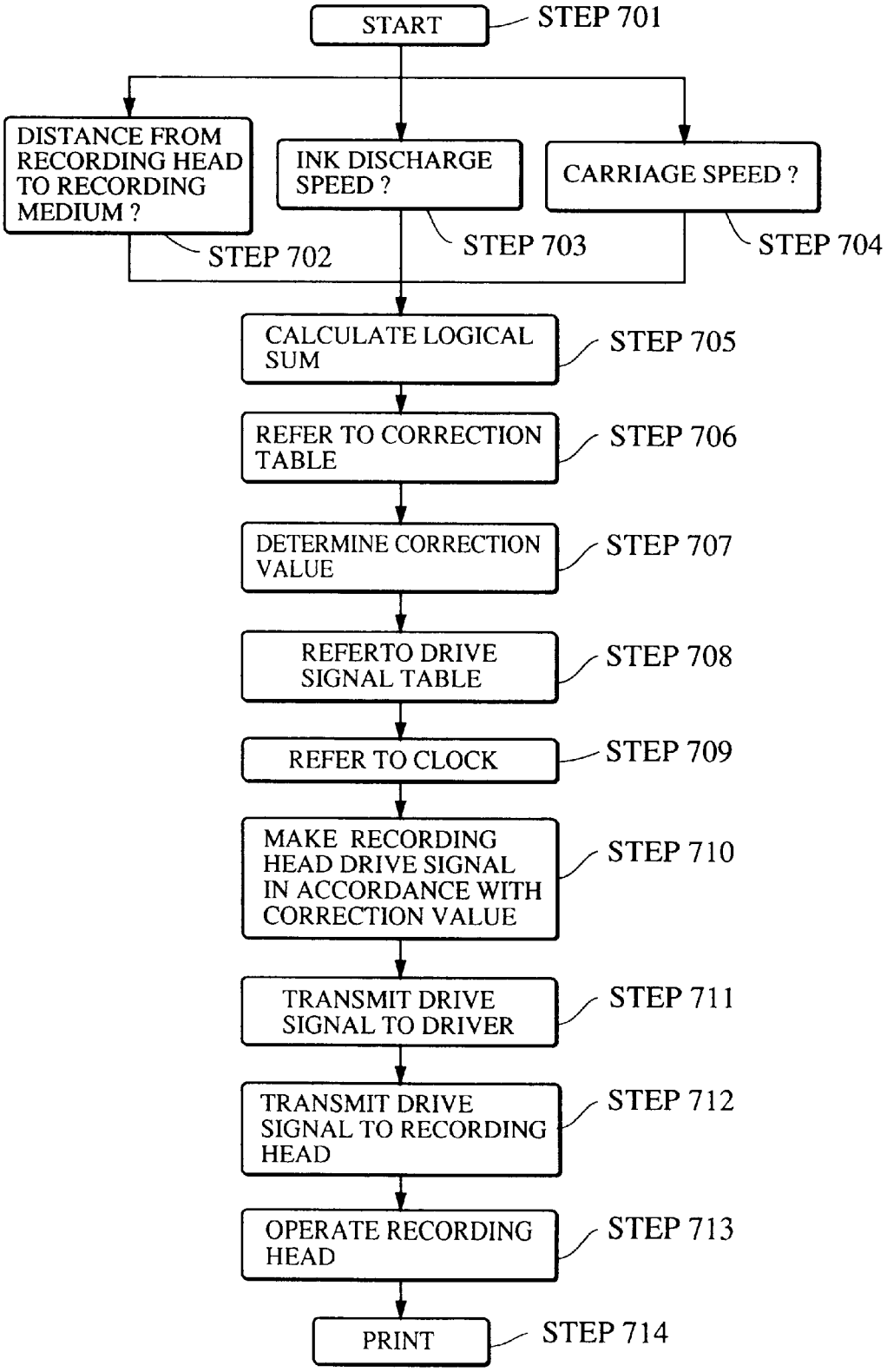
FIGS. 7A and 7B are is a flow chart which illustrates the control process.

FIG. 7 is a flow chart which illustrates the control procedure of the block diagram shown in FIG. 6. First, the control procedure will now be described with reference to FIG. 7A.

When the flow starts in step 701, the processes are performed sequentially and in parallel in steps 702, 703 and 704. In step 702, the distance from the recording head and the recording medium is detected. In step 703, the ink discharge speed Vd is detected, and the carriage speed Vcr is detected in step 704. The logical sum of the results of the detections obtained in steps 702, 703 and 704 is calculated in step 705 by the CPU 501. After the calculation has been performed in step 705, reference to the correction table 505 stored in the ROM 503 is made, and a subject correction value is determined in step 707.

Steps 702 to 707 will now be described in detail with reference to FIGS. 7B and 8. Parameters Vd, Vcr and L have been previously determined while dividing the imaginary variable regions into m, n and p sections, respectively. By making use of subscripts i, j and k, any one of the following values can be selected:

Vd: Vdi (i=1 to m)

Vcr: Vcrj (j=1 to n)

Lk: Lk (k=1 to p)

The values m, n and p may be arbitrarily determined depending upon the accuracy required and the specification of the apparatus (for example, the variable range of the carriage speed and the thickness of the recording medium employed).

Figure 7B:
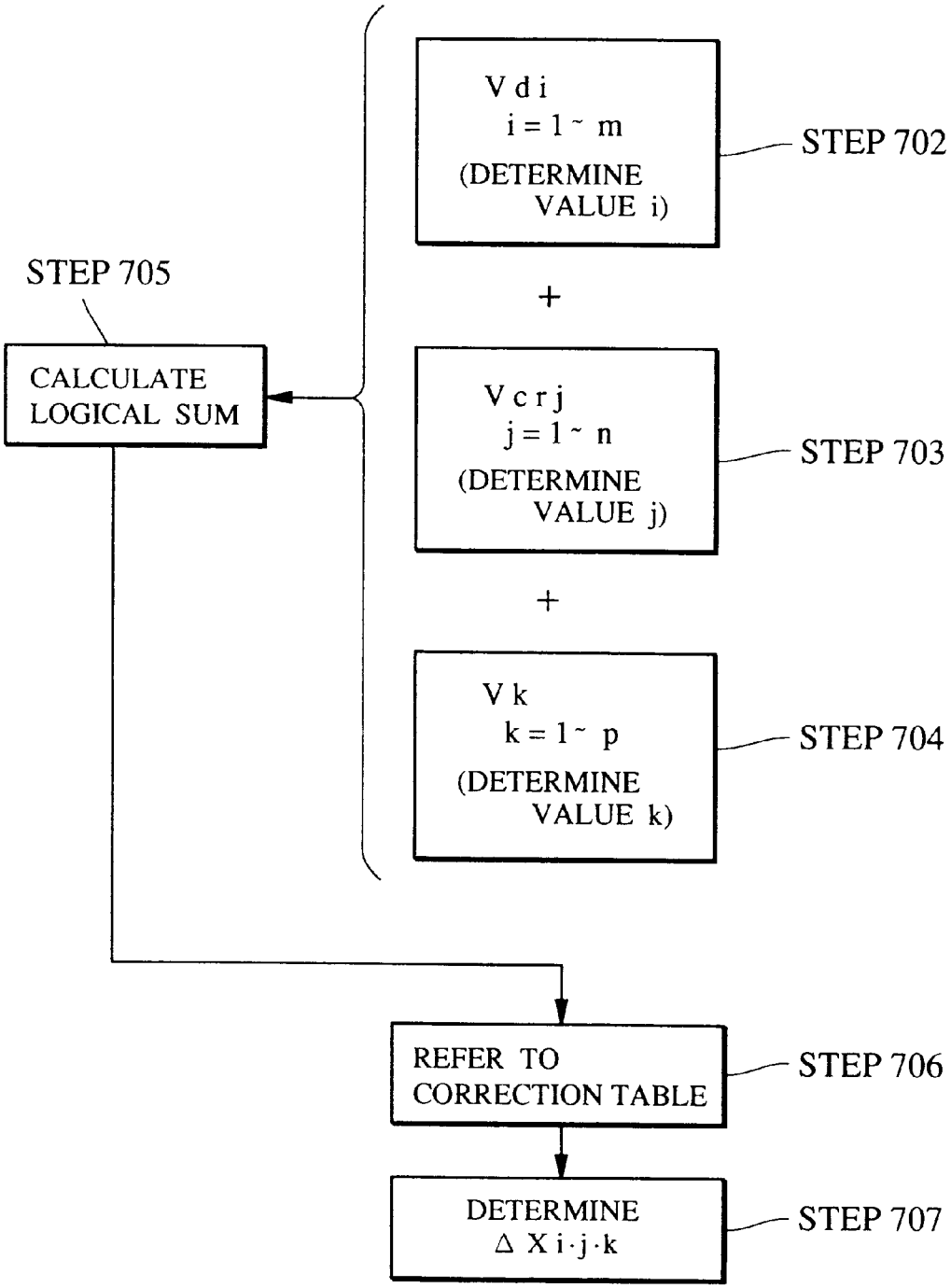

As shown in FIG. 7B, the values of i, j and k are determined in steps 702, 703 and 704. The correction table 505 for expressing a matrix formed by Vdi, Vcrj and Lk is previously prepared. By determining the values of i, j and k, ΔXi.j.k can be determined. In this case, the values to be determined may be varied by (i×j×k) cases.

In step 708, reference is made in parallel to the drive signal table, and reference to the clock is made in step 709. In step 710, a recording head drive signal is provided in accordance with the correction value. In step 711, the drive signal is transmitted to the driver, and transmitted to the recording head in steps 712 and 713. As a result, the recording head is operated, and the recording operation is completed in step 714.

As the foregoing detection means, the distance L from the recording head to the recording medium can be detected by switching on/off the micro-switch 300. The ink discharge speed Vd to be detected in step 702 can be detected in such a manner that reference to the drive signal table 504 is made by the ink discharge speed detection means 508 by way of the CPU 501, and the ink discharge speed Vd can be detected from the current drive method.

The carriage movement speed Vcr to be detected in step 703 can be detected by the carriage speed detection means 509 by way of the CPU 501. The result of the detection made by the reading device 9 can be used to calculate the carriage speed Vcr.

Specifically, the detection of the carriage movement speed Vcr by the reading device 9 is performed in such a manner that the magnetized portions in a specific region on the linear scale 8 are counted and the timing signal obtained from the clock 502 is used to perform a calculation for obtaining the carriage movement speed Vcr. The counts correspond to the distance, while the timing signal corresponds to the duration. By dividing the distance by the duration, the speed can be obtained.

The logical sum of the results of the foregoing detections is calculated, and then reference is made to the correction table 505 to determine the optimum quantity of correction of the bidirectional recording deviation. The result is used to again perform a calculation from the timing signal of the clock 502 and the drive signal table 504. As a result, the drive signal is supplied to the recording head 1 by way of the driver 506.

The previous Vcr (L/Vd) may be directly and sequentially deduced by the CPU 501 on the basis of the results of the detections, instead of referring to the table to determined the correction value.

The deviation correction value thus-obtained enables the operation of the carriage 3 and that of the recording head 1 to be assuredly synchronized with each other by using the magnetic scale. Therefore, the quantity of the deviation can arbitrarily be determined in the bidirectional recording to perform the recording operation. As a result, a high quality image can always be recorded when data is recorded in the bidirectional manner onto each of the various thickness recording mediums at high speed.

Although this embodiment is arranged in such a manner that the state of the lever portion 132 is detected by using the micro-switch 300, the state of the lever portion 132 can be detected by using an optical photo-coupler in place of the micro-switch.

Second Embodiment

A second embodiment of the present invention will now be described with reference to FIGS. 9 and 10.

Figure 9:
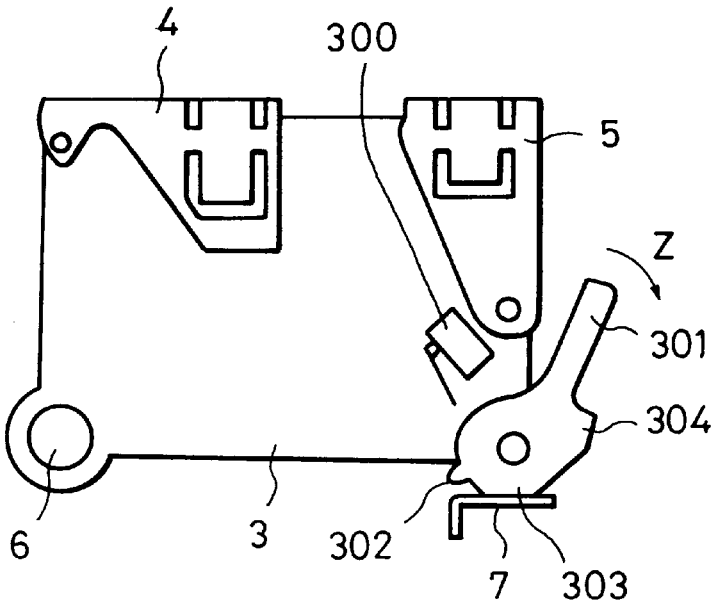
FIG. 9 is a side elevational cross sectional view which illustrates the carriage portion of an ink jet recording apparatus according to a second embodiment of the present invention.
Figure 10:
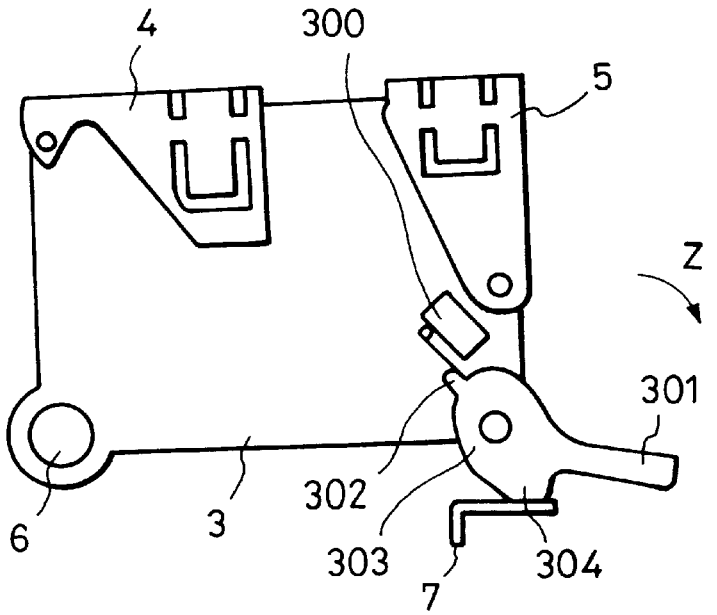
FIG. 10 is a side elevational cross sectional view which illustrates the carriage portion of the ink jet recording apparatus according to the second embodiment of the present invention.

FIGS. 9 and 10 respectively are partial cross sectional views which illustrate the carriage portion of a recording apparatus according to a second embodiment of the present invention.

Whereas the first embodiment is arranged in such a manner that the switch lever is disposed on the frame, the second embodiment is arranged in such a manner that the switch lever is disposed on the carriage.

In FIGS. 9 and 10, the same elements having the same functions as those of the first embodiment are given the same reference numerals. The micro-switch 300 is mounted on the carriage 3. Reference numeral 6 represents a guide shaft which enables the carriage 3 to be moved. Reference numeral 301 represents a lever member having a support point of rotation in the carriage 3, the lever member 301 having a projection 302, and slidable surfaces 303 and 304. The slidable surface 303 is able to slide at the illustrated position while placing on the support surface 7. The guide shaft 6 and the support surface 7 are secured to a frame (not shown) in such a manner that the relative position is always fixed. When the lever member 301 is rotated in a direction designated by an arrow Z shown in FIGS. 9 and 10, the support surface 7 contacts the slidable surface 304, as shown in FIG. 10. Further, the projection portion 302 is rotated to come in contact with the micro-switch 300 so that the micro-switch 300 is switched. FIG. 9 illustrates the case where the recording medium has a usual thickness, while FIG. 10 illustrates the case where a thick recording medium is used.

Since the determined position of the lever member 301 is converted into an electric signal as described above, the ensuing control can be performed in a manner similar to the first embodiment.

Third Embodiment

A third embodiment of the present invention will now be described with reference to FIGS. 11 and 12.

Figure 11:
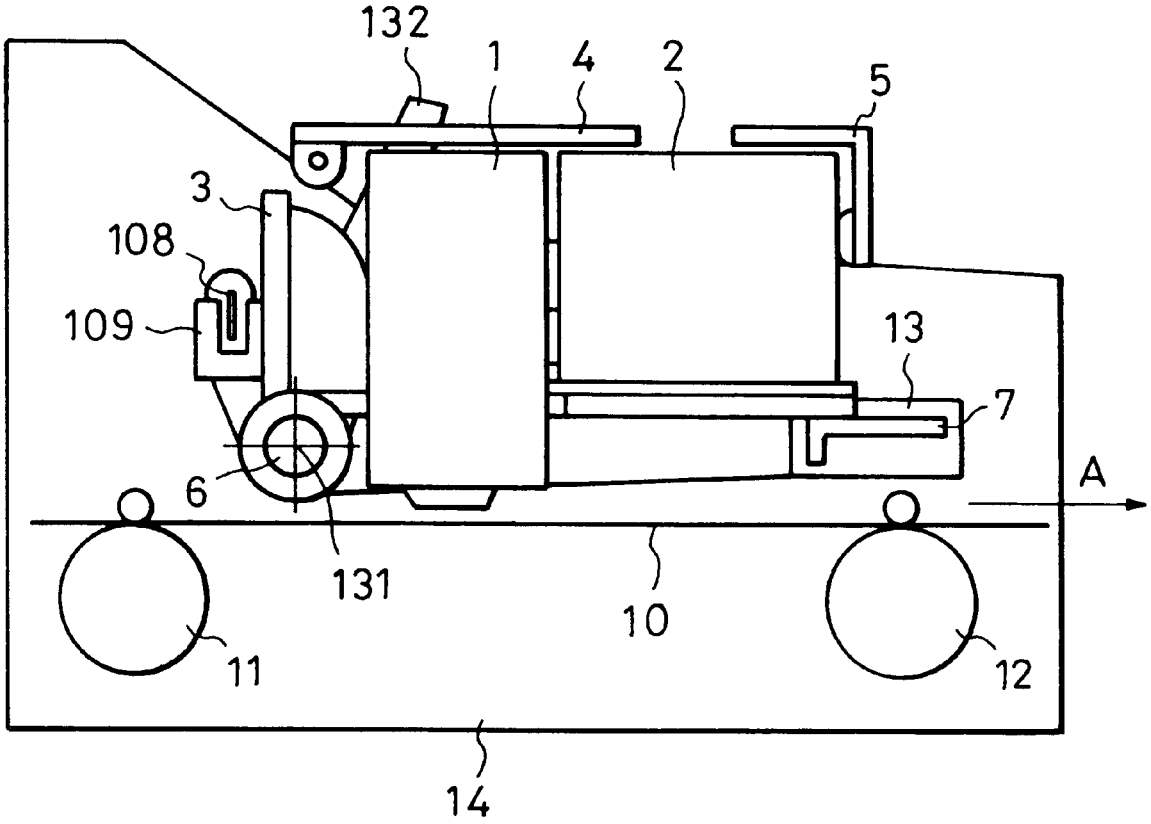
FIG. 11 is a side elevational cross sectional view which illustrates the carriage portion of an ink jet recording apparatus according to a third embodiment of the present invention.
Figure 12:
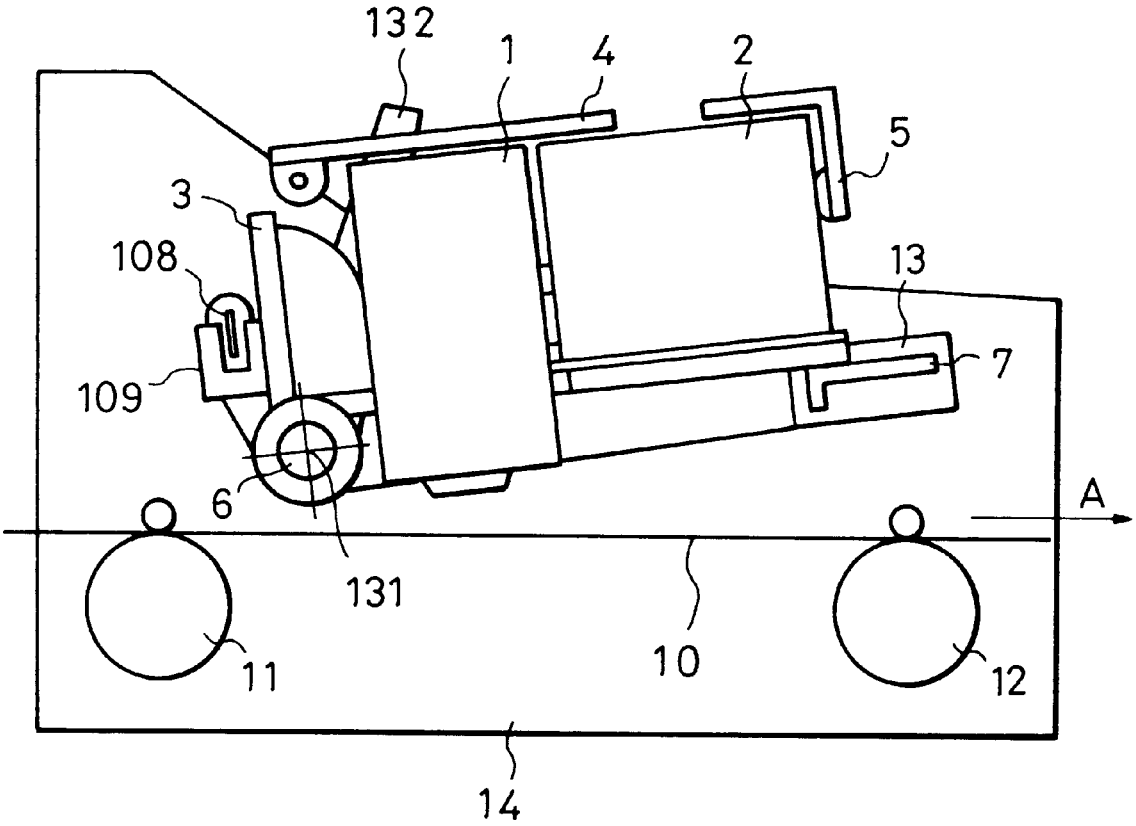
FIG. 12 is a side elevational cross sectional view which illustrates the carriage portion of the ink jet recording apparatus according to the third embodiment of the present invention.

FIGS. 11 and 12 respectively are partial cross sectional views which illustrate a carriage portion of the third embodiment of the present invention.

Although the first and second embodiments are arranged in such a manner that the reading device 9 shown in FIG. 2 is adapted to the magnetic reading method, this embodiment is arranged in such a manner that a reading device 109 constituted by combining a photo-diode and a photo-transistor as shown in FIG. 11 is provided to allow use of the optical reading method.

FIGS. 11 and 12 correspond to FIGS. 3 and 4 according to the first embodiment, wherein the same elements as those found in the first embodiment are given the same reference numerals.

Referring to FIG. 11, a linear scale 108 is formed into an elongated shape having a surface on which is formed an optically-transmissive/shielding pattern at a recording pitch density corresponding to, for example, 180 dots/inch (dpi) or 360 dpi. In the optical method, he linear scale 108 has the transmissive/shielding portion formed on a film made of polymer material or the like or an elongated plate made of inorganic material by photoengraving. Alternatively, metal or metal composite material is etched to form physically a hole/shielding portion so that the transmissive/shielding pattern is formed. The third embodiment provides a resolution limit of about 360 dpi and it is controlled somewhat coarsely as compared with the magnetic reading method according to the first embodiment.

The reading device 109 is fastened to the carriage to obtain the synchronizing signal. In this embodiment, the reading device 109 is branched into two portions each of which includes a photo-diode device and a photo-transistor device in such a manner that an optical axis is established between the foregoing two devices. By passing the linear scale 108 through the branched space, the position of the moved carriage 3 is detected. While synchronizing with the result of the position detection, the recording head 1 performs the recording operation.

FIG. 11 illustrates the case where the recording medium 10 has a usual thickness, and FIG. 12 illustrates a case where data is recorded onto a thick recording medium 10. Also in this embodiment, the rotation of the lever 132 (not shown) causes the guide shaft 6, the support surface 7 and the linear scale 108 to be integrally rotated around the rotation center 131 due to the action of the support member 13 (not shown). Therefore, the relative positions among the foregoing three elements is not changed, and the positional relationship between the linear scale 108 and the reading device 109 is not changed. Therefore, the constant output level of the signal denoting the position of the carriage 3 can always be detected regardless of the thickness of the recording medium. As a result, the position of the carriage 3 can assuredly be controlled.

As described above, if the optical scale is used, the operation of the carriage 3 and that of the recording head 1 can assuredly be synchronized with each other. Therefore, the quantity of the deviation can arbitrarily be determined for bidirectional recording to perform the recording operation. As a result, high quality images can always be recorded when data is, in the bidirectional manner, recorded onto each of the various recording mediums at high speed.

Fourth Embodiment

A fourth embodiment of the present invention will now be described with reference to FIGS. 13 to 15.

Although the first to the third embodiments are arranged in such a manner that the lever switching operation performed by the operator is automatically detected and the predetermined deviation correction is automatically performed, this embodiment is arranged in such a manner that the operator is able to arbitrarily select the foregoing deviation correction by setting a display/control portion.

Figure 13:
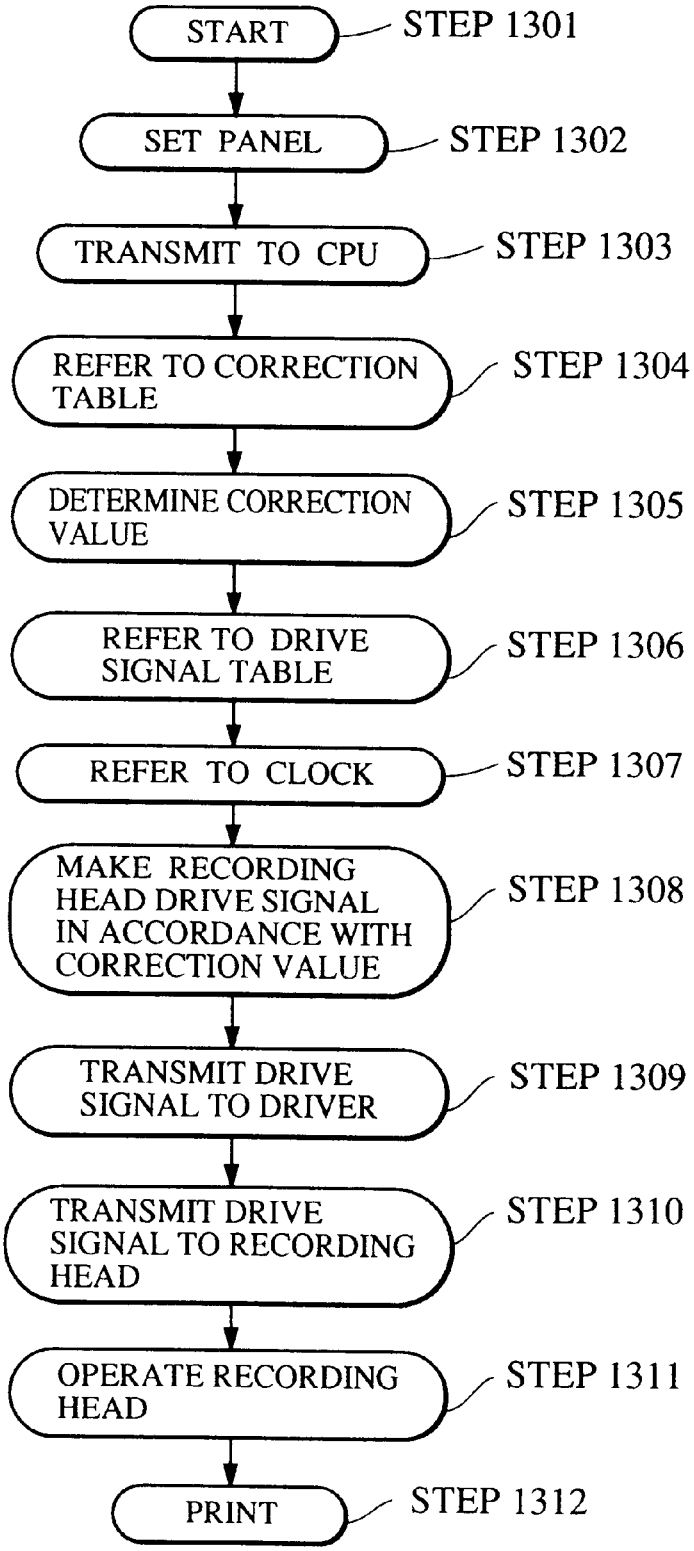
FIG. 13 is a flow chart which illustrates the control process according to a fourth embodiment of the present invention.

FIG. 13 is a flow chart according to this embodiment.

In step 1301, the flow is commenced, and the control panel is set by the operator in step 1302. The foregoing determined value is, in step 1303, transmitted to the CPU, and a reference to the correction table on the ROM is made in step 1304, and the subject correction value is determined in step 1305. In steps 1306 and 1307, a reference to the drive signal table in made in parallel, and a reference to the clock is made. In step 1308, a recording head drive signal is made in accordance with the correction value. In steps 1309 and 1310, the recording head drive signal is transmitted to the driver and the recording head, and the recording head is operated in step 1311. The printing operation is completed in step 1312.

Figure 14:
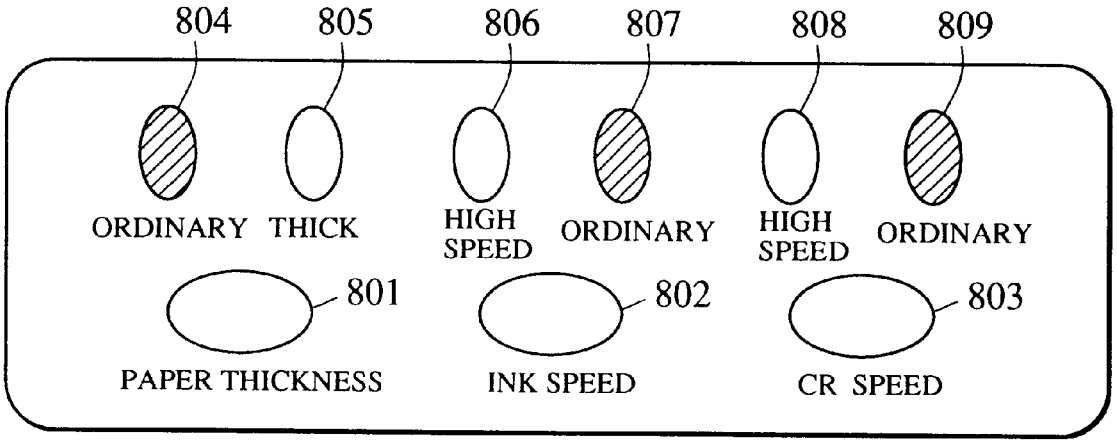
FIG. 14 is a schematic view which illustrates a control panel according to the fourth embodiment.

FIG. 14 is a schematic view which illustrates a portion of the control panel according to this embodiment. Referring to FIG. 14, reference numeral 801 represents a switch capable of selecting the distance L from the recording head to the recording medium to be one of two values. Reference numeral 802 represents a switch that selects the ink discharge speed Vd to have one of two values. Reference numeral 802 represents a switch capable of selecting the carriage speed Vcr to have one of two values. Referring to FIG. 14, reference numerals 804, 805, 806, 807, 808 and 809 represent LED displays, which when illuminated indicate the selected states of the foregoing subject factors by making use of the switches 801, 802 and 803.

As a result of the structure of the control panel as shown in FIG. 14, an operation can set the switches 801, 802 and 803 to achieve the desired settings. Therefore, the quantity of dot deviation occurring in the bidirectional recording operation can be corrected adequately in accordance with settings made by the operator. Hence, a high quality recording operation can be performed.

Figure 15:
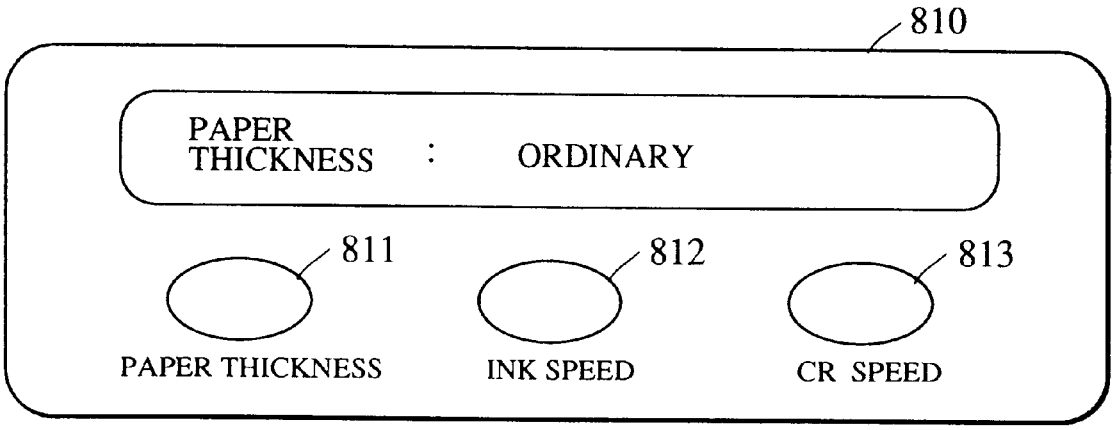
FIG. 15 is a schematic view which illustrates the control panel according to the fourth embodiment.
Figure 16:
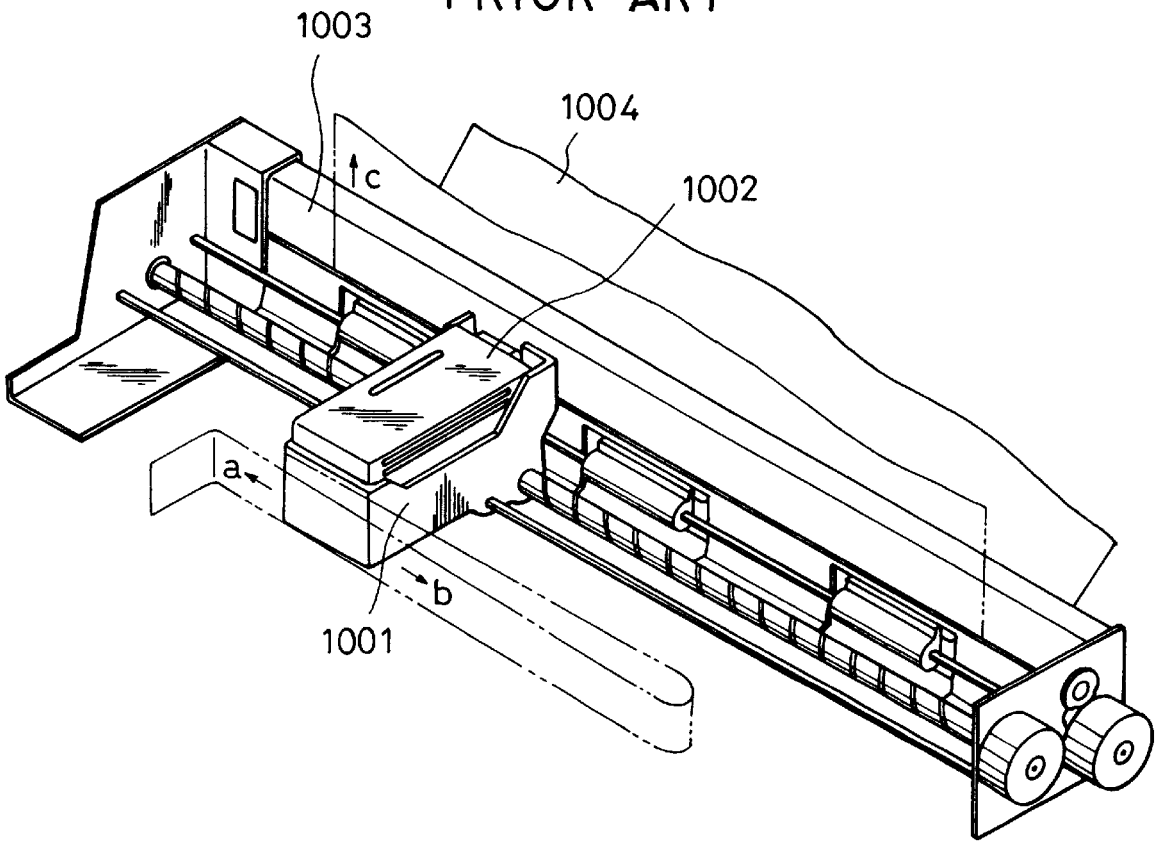
FIG. 16 PRIOR ART
FIG. 16 is a perspective view which illustrates a conventional recording apparatus.
Figure 17:
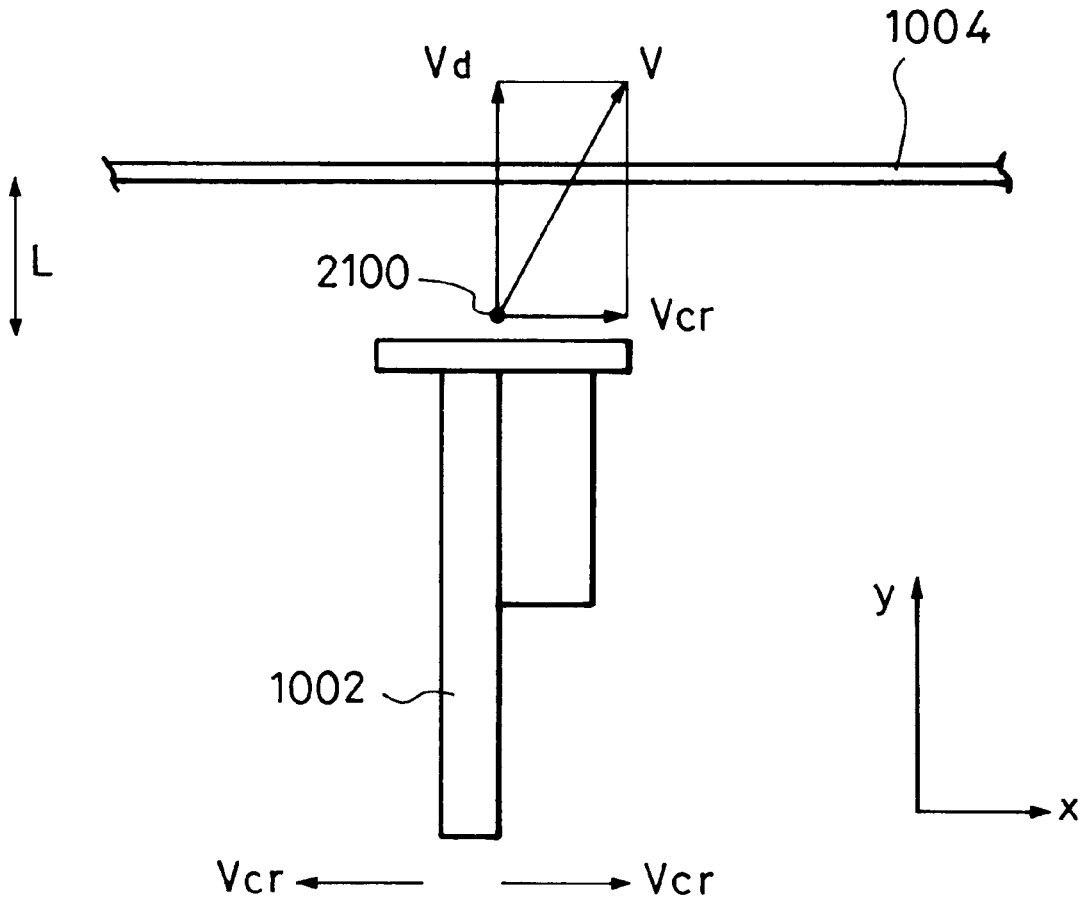
FIG. 17 illustrates a state where ink is discharged to a recording medium.

FIG. 15 illustrates a modification of the control panel 510 shown in FIG. 14, the display portion of the control panel being made of liquid crystal.

Referring to FIG. 15, reference numerals 811, 812 and 813 represent switches capable of selecting the distance L from the recording head to the recording medium, the ink discharge speed Vd and the carriage movement speed Vcr, each have one of two values. Reference numeral 810 represents a liquid crystal display portion capable of, with segment character display, displaying the selected distance L from the recording head to the recording medium, the ink discharge speed Vd and the carriage speed Vcr. The settings depicted in FIG. 15 correspond to the case where the distance L from the recording head to the recording medium is the usual distance.

As a result of the structure of the control panel, the operator is able to select the desired values by operating the switches 811, 812 and 813. In accordance with settings made by the operator, the quantity of the dot deviation occurring in the bidirectional recording operation can be corrected adequately, and therefore high quality correction can be performed.

Although the embodiment employs the method of directly selecting desired values by making use of switches, the method in which the operator determines the values is not limited to this. As an alternative to the method in which the factors to be corrected are directly displayed and the factors are changed, a method may be employed in which printing modes are selectively provided, correction values corresponding to the various printing modes are stored by a correction table, and changes of the correction values are indirectly caused.

If the foregoing method is employed in which the printing modes are provided, the discharge speed Vd, the carriage speed Vcr and the distance L from the recording head to the recording medium are set, and the correction values for correcting the quantity of the dot deviation occurring in the bidirectional recording operation are determined, the operator is able to operate the apparatus without having to consider complicated recording conditions. However, the distance from the recording head to the recording medium still must be mechanically adjusted. Therefore, it cannot be automatically adjusted in accordance with the selected printing mode. If, however, a mechanism capable of adjusting the distance is provided, the cost of the device increases undesirably. Accordingly, the distance L from the recording head to the recording medium may be adjusted by a structure arranged in such a manner that the adjustment is performed by the lever 132 shown in FIGS. 3 and 4 or the lever 301 shown in FIGS. 9 and 10, and the operator selects a mode, such as a "plain paper mode" or "thick paper or envelope mode" or the like from the control panel in accordance with the foregoing adjustment to perform the correction in accordance with the selected mode.

Although each of the foregoing embodiments provides means for collectively detecting the ink discharge speed from the recording head, the carriage movement speed and the distance from the recording head to the recording medium, the correction needed to correspond to the change in the ink discharge speed Vd can be omitted because the ink discharge speed Vd is usually about 7 to 30 m/sec, the carriage movement speed Vcr is abut 1 m/sec and the distance from the recording head to the recording medium is about 1 mm, and so the ink discharge speed Vd can be considered to be sufficiently high with respect to the carriage movement speed Vcr. That is, the necessity of including all of the foregoing means can be omitted if the factor responsible for the deviation occurring in the bidirectional recording can be sufficiently corrected.

As for the type and the number of the recording heads to be mounted, a plurality of recording heads adaptable to a plurality of different-color inks having different concentrations may be employed in place of the structure comprising one single-color recording head.

As for the recording mode of the recording apparatus, the present invention can effectively be adapted to an apparatus capable of recording a color-combined image composed of different colors or a full color image obtained by mixing colors together by integrally forming the recording head or by combining a plurality of recording heads as well as the recording mode for recording using only single color such as black.

Although the discharge control of the recording head is performed by using a position scale signal as the standard, it is apparent that the control may be performed by monitoring the number of the pulses of an alternative signal, for example, a carriage drive pulse motor if the position scale is not provided for the apparatus.

Even if the temperature of the recording head is detected by a temperature sensor mounted on the recording head or if the temperature in the apparatus or the outside temperature is detected by a temperature sensor mounted on the carriage to operate the recording head to be adaptable to the temperature change which changes the ink discharge speed Vd and the carriage speed Vcr of the recording head, control can be performed while changing the quantity of correction in the bidirectional recording operation to correspond to the ink discharge speed Vd and the carriage speed Vcr.

As described above, the present invention enables deviations in the position of the recording dots occurring in bidirectional recording to be corrected to correspond to the thickness of the recording medium and the recording speed. The present invention allows high speed recording to be performed and permits a variety of recording mediums to be used. Further, the apparatus can be used easily and high-quality recording can be performed regardless of the type of the recording medium.

Among the ink jet recording apparatuses, the present invention enables an excellent effect to be obtained when it is adapted to a recording head or a recording apparatus adapted to a method having means that generates heat energy to discharge ink and using the heat energy thus-generated to change the state of the ink. The foregoing method raises the density of recording and improves the recording precision.

Fifth Embodiment

A recording apparatus capable of preventing deviations of recorded dots occurring due to the change of the relative speed between the recording means and the recording medium caused from the change in the environment will now be described with reference to the drawings.

Figure 18:
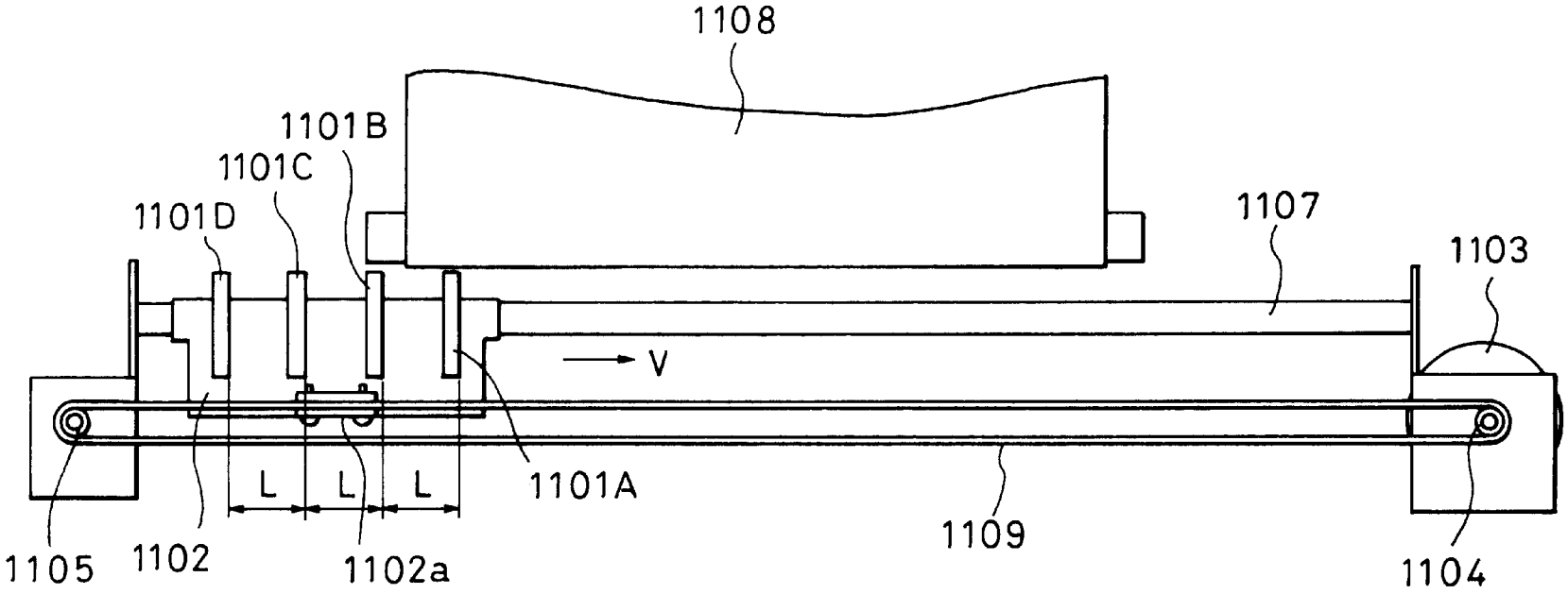
FIG. 18 PRIOR ART
FIG. 18 is schematic view which illustrates a conventional recording apparatus.
Figure 19:
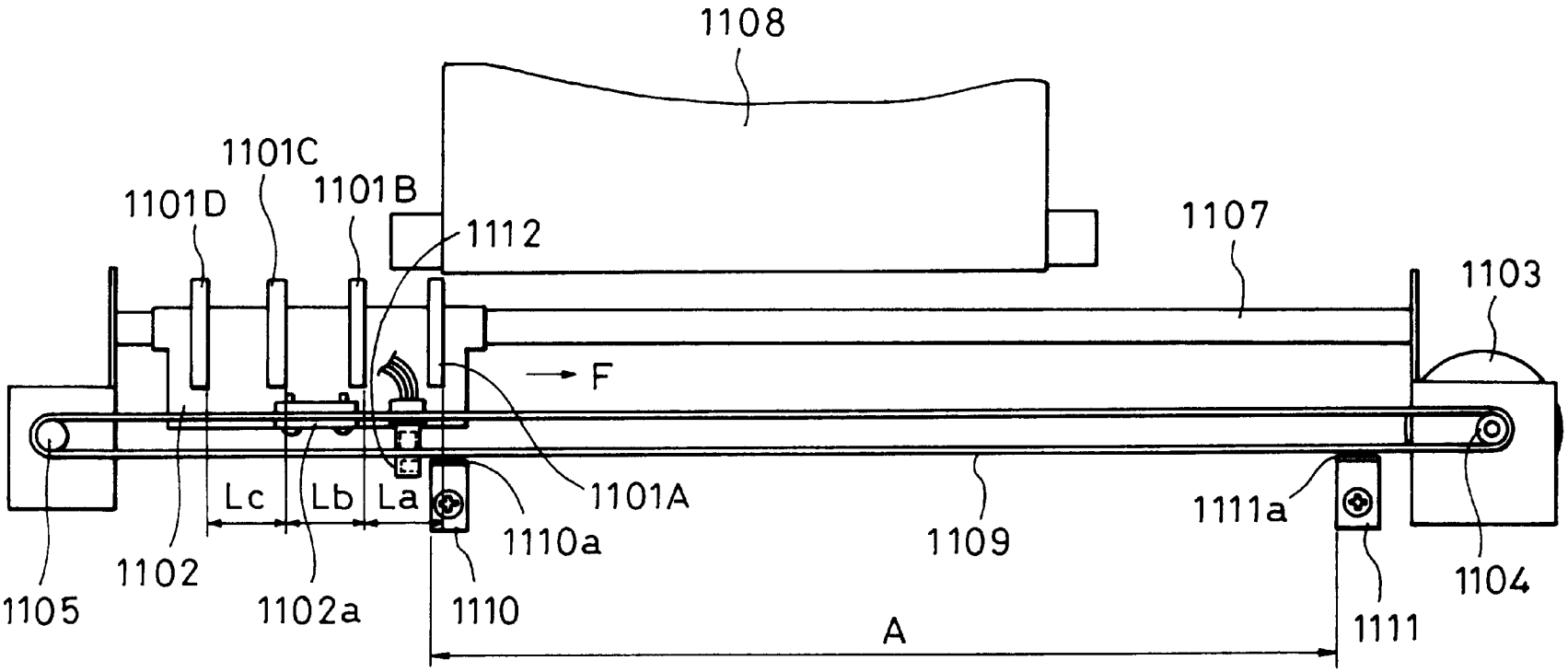
FIG. 19 is a plan view which illustrates a recording apparatus according to an embodiment of the present invention.

FIG. 19 illustrates a recording apparatus according to a fifth embodiment of the present invention. Like the description made with reference to FIG. 18, the recording apparatus according to this embodiment comprises recording means (ink jet heads) 1101A to 1101D disposed to use, for example, yellow, magenta, cyan and black inks. The same elements are given the same reference numerals. The apparatus according to the present invention differs from the apparatus shown in FIG. 18 in that members 1110 and 1111 to be detected for use to detect passing of the carriage 1102 are, by screws or the like, fixed on the two sides of the recording region of the main body with respect to the recording medium and that the carriage 1102 has a detection means 1112 mounted thereon for detecting the portions 1110*a* and 1111*a* of the detected members 1110 and 1111. In this embodiment, the detection means 1112 is a transmissive-type photo-sensor, while the portions 1110*a* and 1111*a* to be detected are light shielding portions.

The members 1110 and 1111 to be detected are adjusted to be a predetermined distance A from the light shielding portions 1110*a* and 1111*a*. By measuring the time $T_A$ from the moment the carriage 1102 commences moving in the direction designated by an arrow F (recording is performed in this embodiment when the carriage 1102 is moved in the foregoing direction) and the photo-sensor 1112 is turned off by the light shielding portion 1110*a* to the time at which the photo-sensor 1112 is again turned off by the light shielding portion 1110*a* to count, for example, clock pulses for determining the drive frequency of the recording means, the movement speed VA of the carriage 1102 in the recording region can be calculated.

Figure 20:
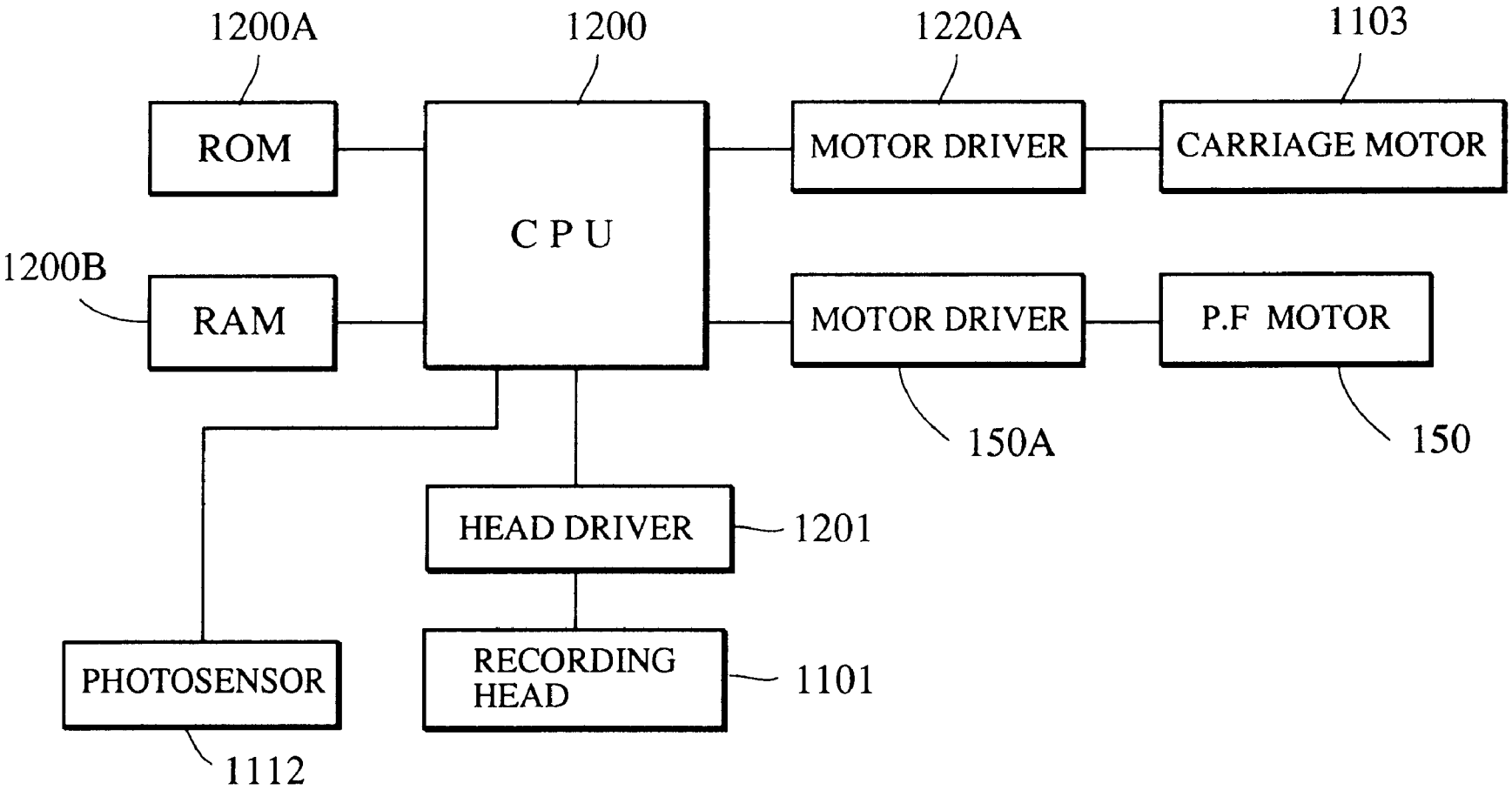
FIG. 20 is a block diagram which illustrates a control system of the recording apparatus.
Figure 21:
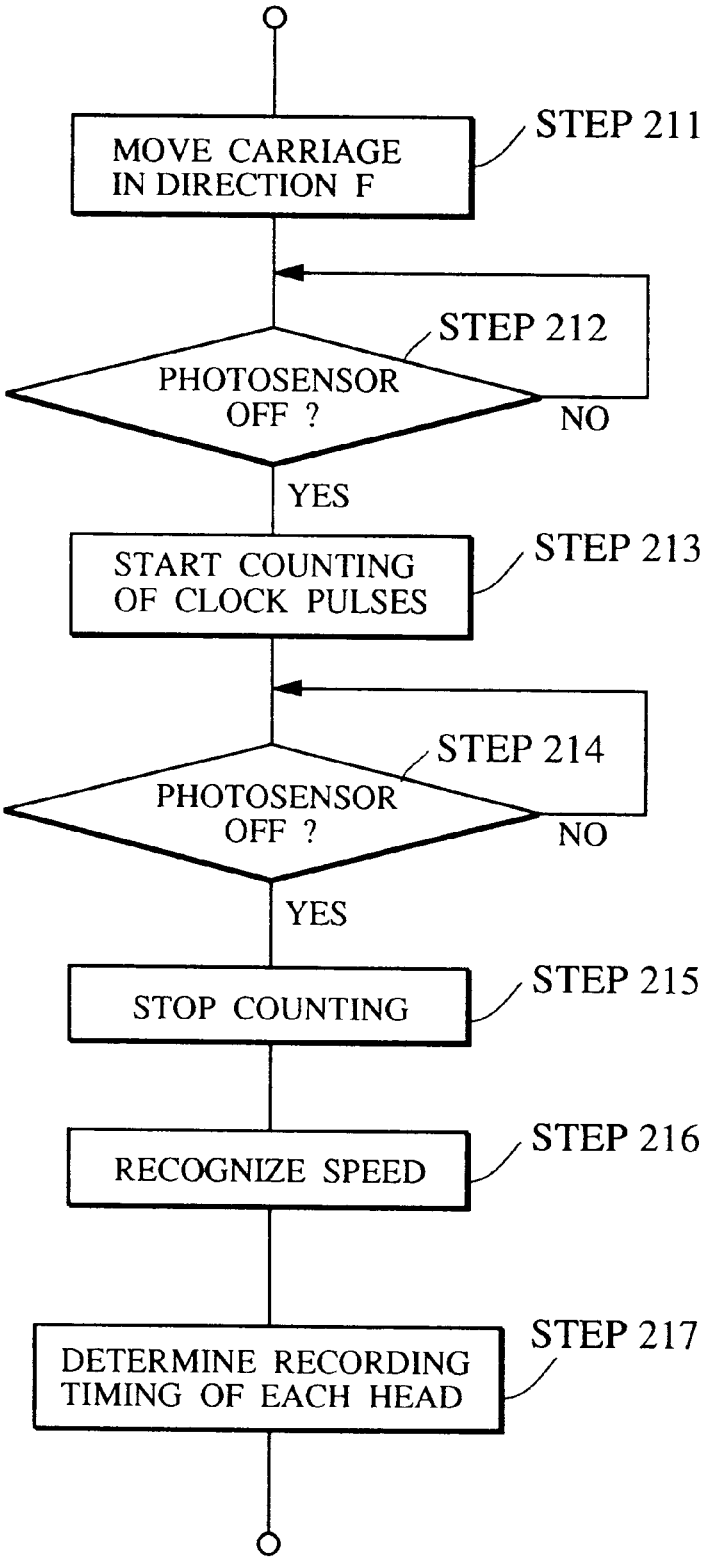
FIG. 21 is a flow chart which illustrates the process for determining recording timing.
Figure 22:
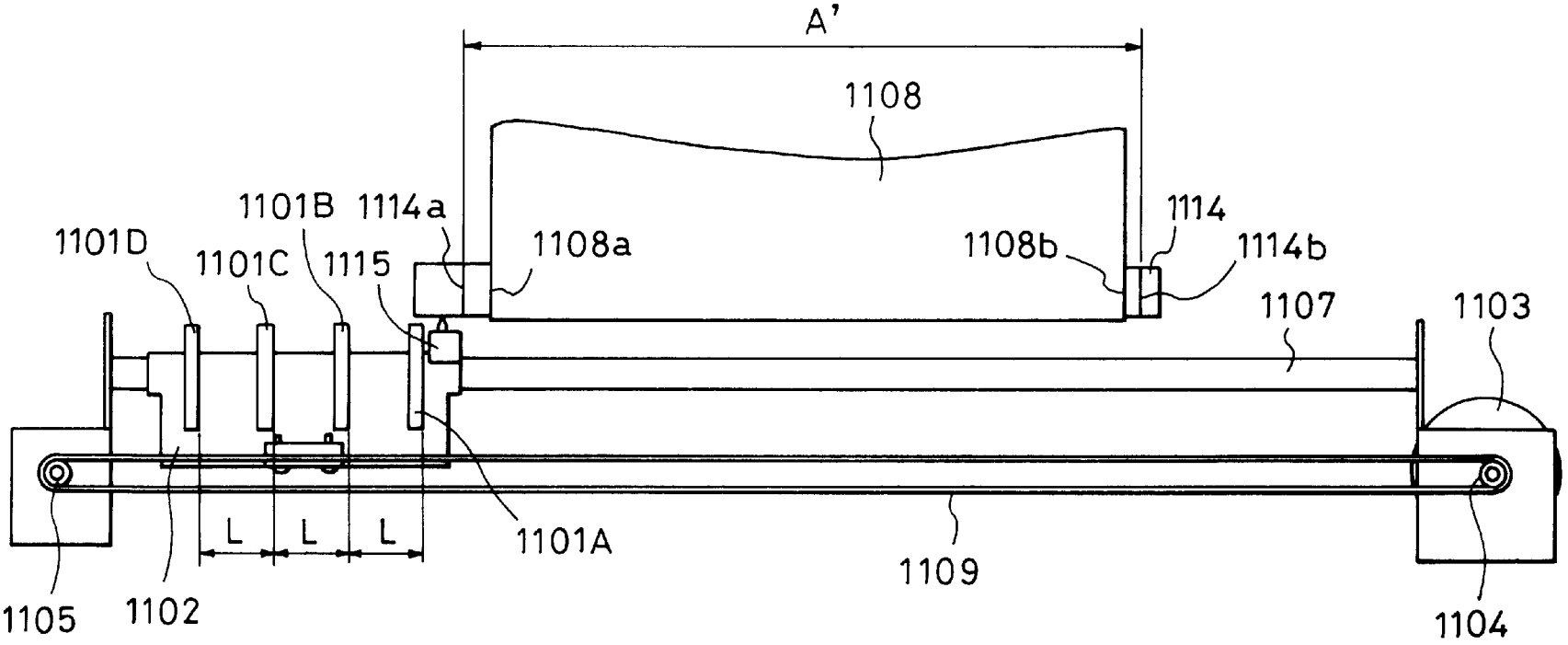
FIG. 22 is a plan view which illustrates a recording apparatus according to an embodiment of the present invention.

A CPU 1200 shown in FIG. 20 performs the process shown in FIG. 21 for determining the drive timing of each head and a control process for each portion of the apparatus and a data process. A ROM 1200A stores fixed data such as programs corresponding to the processes, and a RAM 1200B is used as a working area for the foregoing processes.

The recording head 1101 (meaning collectively the ink jet heads 1101A through 1101D) discharges ink when the CPU 1200 supplies recording data and a drive control signal to a head driver 1201 for operating a device for generating energy which is used to discharge ink. The CPU 1200 supplies data for controlling the drive timing of each head to a head driver 1201 so that each head is operated at adequate timing corresponding to the carriage movement speed. The CPU 1200, by way of motor drivers 1220A and 150A, controls the rotation of a carriage motor 1103 for moving the carriage 1102 and that of a paper feeding (P.F) motor 150 for rotating a roller for conveying a recording paper sheet 1108.

FIG. 21 shows an example of the flow of a process for determining the drive timing (the recording timing) of each of the heads 1101B and 1101D. The foregoing process may be performed for each recording movement operation or a plurality of recording movement operations. It may be performed every time a fixed quantity of recording medium sheets have been recorded, or at a predetermined time. If an environment condition detection means is provided for the recording apparatus, the correction may be performed in such a manner that the output from the environment condition detection means is detected and the correction is performed if the temperature has been changed by more than a given amount after one operation has been completed. The foregoing process may be performed while moving the carriage under the same condition as that for the recording operation by interrupting the recording operation or prior to the same in place of performing the process during the recording operation.

In any case, when the foregoing process is begun, the motor 103 is rotated in step 211 so that the carriage 1102 is moved from the left portion shown in FIG. 19 in direction F shown in FIG. 19. When the fact, that the photo-sensor 1112 is turned off by the light shielding portion 1110*a* during the movement of the carriage 1102, is detected in step 212, counting of the clock pulses is commenced in step 213. When the carriage 1102 has been moved to the right portion shown in FIG. 19 and a fact that the photo-sensor 1112 has been turned off by the light shielding portion 1111*a* has been detected in step 214, counting of the clock pulses is stopped in step 215. By using the result of counting of the clock pulses, the passage time of a range A can be recognized. In accordance with the passage time, the movement speed of the carriage 1102 is calculated in step 216. In next step 217, the recording timing of each head is determined.

The process for calculating the speed and determining the timing will now be described in detail. The distances La, Lb and Lc of the ink jet heads 1101A and 1101D mounted on the carriage 1102 are previously measured at the time of the assembly or the adjustment of the apparatus and stored by an arbitrary means such as a ROM, EEPROM, DIP switch or a volume. As an alternative to this, it is previously supplied to an arbitrary means that measures the distance. In accordance with the movement speed $V_A(=A/T_A)$, the recording timing of the ink jet heads 1101B, that of 1101C and that of 1101D can be determined to be $La/V_A$, $(La+Lb)/V_B$ and $(La+Lb+Lc)/V_c$, respectively.

Since A, La and Lc are constants in the actual process, a relationship expressed as $La/V_A=(La/L)\cdot T_A=mT_A$ (m is a constant) is held. Therefore, the recording timing can be determinedly by simply multiplying the measured time by coefficient m. Even if the speed has been changed to $V_A'$ due to the change of the environmental conditions, the recording timing may be $La/V_A'$ $(La+Lb)/V_A'$ and $(La+Lb+Lc)/V_A'$ which respectively are $(La/A)\cdot T_A'$ $\{(La+Lb)/A\}\cdot T_A'$ and $\{(La+Lb+Lc)/A\}\cdot T_A'$. Therefore, the recording timing can be corrected by measuring the time $T_A'$ taken from a moment at which a fact that the photo-sensor 1112 is turned off by the light shielding portion 1110*a* is detected to a moment at which a fact that the photo-sensor 1112 is again turned off by the light shielding portion 1111*a*. By arranging the measuring time and the correction values into a table to be stored in the ROM, the foregoing calculations can be omitted.

Although the foregoing embodiment is arranged in such a manner that the photo-sensor 1112 is mounted on the carriage 1102, another structure capable of performing similar correction may, of course, be employed in which the light shielding portion (portion to be detected) is formed in the carriage 1102 and a photo-sensor (detection means) is disposed in place of the members 1110 and 1111 to be detected and formed in the apparatus body. As an alternative to the photo-detection method, another detection method, such as a magnetic detection method, may, of course, be employed.

Although the foregoing embodiment is arranged in such a manner that the measurement is performed by using an exclusive measuring means in order to correct the deviation of the recorded dots, a reflective-type photo-sensor 1115 which measures the width of the paper and which is, if any, mounted on the carriage of the recording apparatus, may be used.

The foregoing photo-sensor 1115 is usually moved along a platen 1114 for restricting the recording surface of the recording paper to reach the end 1108*a* of the recording paper at which the photo-sensor 1115 detects the increase in the reflectance, that is, recognizes the end of the recording paper. When the photo-sensor 1115 exceeds the opposite end 1108*b* of the recording paper, the other end of the recording paper can be recognized. When the photo-sensor 1115 for measuring the width of the recording paper is used to correct the deviation of the dot recorded, markings 1114*a* and 1114*b* each exhibiting high reflectance are disposed on the platen to be separated from each other by distance A'. When the deviation of the dot recorded is corrected, the time taking for the photo-sensor 1115 to detect the markings is measured and ensuing process is performed as in the foregoing embodiment. In this case, a similar effect can be obtained.

The foregoing embodiment is arranged in such a manner that two terminative ends of the recording region is measured. Since no acceleration/deceleration takes place in the recording region and the carriage is moved at a constant speed, the foregoing structure is a simple and preferred structure to recognize correctly the moving speed such as the recording operation. However, the position of the measurement and the number of the measuring points may, of course, be determined if correct recognition can be performed.

Although the apparatus according to this embodiment is arranged to perform the recording operation in only one direction of the movement, the apparatus may perform the recording operation during the reciprocating movement. In this case, a head 101D which is the leading head at the time of the returning movement performed for recording data is made to be the standard to determine the recording timing of each head.

Although the foregoing embodiment is arranged in such a manner that the present invention is adapted to be used with the so-called serial printer, the present invention may be adapted to be used in a recording apparatus comprising a plurality of line-type recording heads extending along the conveyance passage for the recording paper in a direction traversing the passage. In this case, the deviation among a plurality of heads of the recording apparatus is corrected which occurs due to the change in the speed, at which the recording paper is conveyed, caused from the change of the environmental conditions. In this case, a means is provided for detecting the speed at which the recording paper is conveyed.

Although the correction is performed in accordance with the time taken to perform a predetermined-distance conveyance or the movement speed obtained from the time, a means (for example, a position sensor) for detecting the length of movement per unit time may be used to perform the correction in accordance with the foregoing length of movement or the movement speed obtained from the length of movement.

As described above, the present invention disclosed with the description of this embodiment is arranged in such a manner that the relative movement speed between the recording means and the recording medium or the time taken to complete the movement is measured to correct the recording timing of each of the plural recording means. As a result, a recording apparatus can be provided which is able to prevent deviations from occurring in the superposition of the recorded dots and always records high-quality images even if the environment has changed or the drive means or the transmission means has been changed.

The present invention, constructed as described in the foregoing embodiments, can be applied to recording apparatuses adapted to various methods, such as the dot impact method, thermal recording method or the like, as well as the ink jet recording method. Among the ink jet recording apparatuses, the present invention enables an excellent effect to be obtained when it is adapted to a recording head or a recording apparatus adapted to a method having means (for example, an electro-thermal converter or laser beams) that generates heat energy to discharge ink and using the heat energy thus-generated to change the state of the ink. The foregoing method raises the recording density and improves the recording precision.

As for the typical structure and the principle of the ink jet recording method that uses the means for generating the heat energy to change the state of the ink to discharge ink and perform the recording operation, it is preferable that the basic structures disclosed in, for example, U.S. Pat. No. 4,723,129 or U.S. Pat. No. 4,740,796 be employed. The aforesaid method can be adapted to both a so-called on-demand type apparatus and a continuous type apparatus. In particular, satisfactory effects can be obtained when the on-demand type apparatus is employed because of the structure arranged in such a manner that one or more drive signals, which rapidly raise the temperature of an electro-thermal converter disposed to face a sheet or a fluid passage which holds the fluid (ink) to a point higher than the temperature at which nucleate boiling takes place are applied to the electro-thermal converter so as to generate heat energy in the electro-thermal converter and to cause at the heat effecting surface of the recording head film boiling to take place so that bubbles can be formed in the fluid (ink) to correspond to the one or more drive signals. The expansion/contraction of the bubble will cause the fluid (ink) to be discharged through a discharge opening so that one or more droplets are formed. If a pulse shaped drive signal is employed, the bubble can be expanded/contracted immediately and properly, causing a further preferred effect to be obtained because the fluid (ink) can be discharged with excellent responsiveness. It is preferable that a pulse drive signal such as that disclosed in U.S. Pat. No. 4,463,359 or U.S. Pat. No. 4,345,262 be employed. If conditions such as those disclosed in U.S. Pat. No. 4,313,124, which relates to the temperature rising ratio at the heat effecting surface, are employed, particularly satisfactory recording results can be obtained.

As an alternative to the structure (linear fluid passage or perpendicular fluid passage) of the recording head disclosed in each of the aforesaid inventions and having an arrangement that discharge ports, fluid passages and electro-thermal converters are combined, a structure having an arrangement such that the heat effecting surface is disposed in a bent region as disclosed in U.S. Pat. No. 4,558,333 or U.S. Pat. No. 4,459,600 may be employed. In addition, the following structures may be employed: a structure having an arrangement such that a common slit is formed to serve as a discharge section of a plurality of electricity-to-heat converters as disclosed in Japanese Patent Laid-Open No. 59-123670; and a structure in which an opening for absorbing pressure waves of heat energy is disposed to correspond to the discharge section as disclosed in Japanese Patent Laid-Open No. 59-138461. That is, the present invention enables recording to be performed assuredly and efficiently regardless of the structure of the recording head.

As a full-line type recording head having a length capable of covering the width of the largest recording medium which can be recorded by the recording apparatus, a structure which achieves the requisite length by combining a plurality of recording heads or a structure having a single integrated recording head as disclosed in any of the aforesaid specifications may be employed.

The foregoing serial type and a chip type recording head which can be electrically connected to the body of the apparatus or to which ink can be supplied from the body of the apparatus when it is fastened to the body of the apparatus may be employed. Furthermore, a cartridge recording head having an ink tank integrally formed with the recording head may be employed.

It is preferred to additionally employ the recording head restoring means and an auxiliary means provided as the component of the present invention because the effect of the present invention can be further stabilized. Specifically, it is preferable to employ combinations of a recording head capping means, a cleaning means, a pressurizing or suction means, an electro-thermal converter, an auxiliary heating element or a sub-heating means constituted by combining the converter and the auxiliary heating element for effecting a sub-discharge mode in which a discharge is performed independently from the recording discharge in order to stably perform the recording operation.

As for the type and the number of the recording heads to be mounted, two or more heads may be mounted to use a plurality of inks having different colors and/or densities. That is, the recording apparatus may be arranged to be capable of recording a color-combined image composed of different colors or a full color image obtained by mixing colors to each other by integrally forming the recording head or by combining a plurality of recording heads as well as recording only a main color such as black.

Although fluid ink is employed in each of the aforesaid embodiments of the present invention, ink which is solid at room temperature or below as well as ink that softens at room temperature, or ink which is formed into a fluid when the recording signal is supplied may be employed because the aforesaid ink jet recording method is ordinarily designed in such a manner that the temperature of ink is controlled to remain within a range from 30° C. to 70° C. so as to keep the viscosity of the ink in a stable discharge range. Furthermore, ink of the following types can be adapted to the present invention: ink which is liquefied when heat energy is supplied in response to the recording signal so as to be discharged in the form of fluid ink, the aforesaid ink being exemplified by ink of the type in which a temperature rise due to application of the heat energy is positively prevented by utilizing the temperature rise as energy of state change from the solid state to the liquid state; and ink which is solidified when it is unused for the purpose of preventing ink evaporation. Furthermore, ink which is first liquefied when supplied with heat energy may be adapted to the present invention. In the aforesaid case, the ink may be of a type which is held as fluid or solid material in a recess of a porous sheet or a through hole at a position to face the electro-thermal converter, as disclosed in Japanese Patent Laid-Open No. 54-56847 or Japanese Patent Laid-Open No. 60-71260. It is most preferred that the ink be adapted to the aforesaid film boiling method.

The ink jet recording apparatus according to the present invention may be in the form of a copying apparatus combined with a reader or the like, or a facsimile apparatus having a transmission/receiving function as well as an apparatus serving as image output terminal equipment of information processing apparatus such as a computer. Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. A recording apparatus that uses a recording head for recording a data on a recording medium by discharging an ink, said recording apparatus comprising:

a carriage on which said recording head is mounted;

moving means for causing said carriage to reciprocate with respect to said recording medium with a forward directional relative movement and a rearward directional relative movement;

recording control means for controlling said recording head during a moving operation performed by said moving means to record said data on said recording medium;

setting changing means for changing a setting of a distance from said recording head to said recording medium, a speed at which said carriage is relatively moved by said moving means and an ink discharge speed from said recording head, thereby setting set conditions;

storage means for storing a correction value for correcting a deviation occurring in a recording operation between a forward moving operation of said carriage and a rearward moving operation of said carriage to correspond to the setting of the distance, the speed and the ink discharge speed which are set by said setting changing means;

selection means for selecting said given correction value from said storage means, said given correction value corresponding to a plurality of set conditions set by said setting changing means; and head drive means for correcting a recording timing of said recording head in accordance with said correction value selected by said selection means and operating said recording head.

2. A recording apparatus according to claim 1 further comprising a position detection means for detecting a position of said carriage in a relative moving direction, wherein said position detection means comprises a position scale disposed along a movement range to be relatively covered by said carriage and a position detection device provided for said carriage.

3. A recording apparatus according to claim 2, wherein said position detection means magnetically detects the position of said carriage in said relative moving direction.

4. A recording apparatus according to claim 2, wherein said position detection means optically detects the position of said carriage in said relative moving direction.

5. A recording apparatus according to claim 1, wherein said change of the setting of said distance from said recording head to said recording medium is performed by making use of a lever provided for said recording apparatus.

6. A recording apparatus according to claim 1, wherein said change of the setting of said distance from said recording head to said recording medium is performed by making use of a lever provided for said carriage.

7. A recording apparatus according to claim 1, wherein said head drive means corrects said recording timing in a single directional recording of said forward directional relative movement and said rearward directional relative movement of said carriage caused by said moving means.

8. A recording apparatus according to claim 1, wherein said recording head changes a state of said ink by heating and discharging said ink in accordance with said change of said state.

9. A recording apparatus that uses a recording head for recording a data on a recording medium by discharging an ink, said recording apparatus comprising:

a carriage on which said recording head is mounted;

moving means for causing said carriage to reciprocate with respect to said recording medium with a forward directional relative movement and a rearward directional relative movement;

recording control means for controlling said recording head during a moving operation performed by said moving means to record said data on said recording medium;

detection means for detecting a distance from said recording head to said recording medium, a speed at which said carriage is relatively moved by said moving means and an ink discharge speed from said recording head;

storage means for storing a correction value for correcting a deviation occurring in a recording operation between a forward moving operation of said carriage and a rearward moving operation of said carriage to correspond to a result of detection performed by said detection means;

selection means for selecting said given correction value from said storage means, said given correction value corresponding to the result of detection performed by said detection means; and head drive means for correcting a recording timing of said recording head in accordance with said given correction value selected by said selection means and operating said recording head.

10. A recording apparatus according to claim 9 further comprising position detection means for detecting a position of said carriage in a relative moving direction, wherein said position detection means comprises a position scale disposed along a movement range to be covered by said carriage and a position detection device provided for said carriage.

11. A recording apparatus according to claim 10, wherein said position detection means magnetically detects the position of said carriage in said relative moving direction.

12. A recording apparatus according to claim 10, wherein said position detection means optically detects the position of said carriage in said relative moving direction.

13. A recording apparatus according to claim 9 further comprising:

adjustment means for adjusting said distance from said recording head to said recording medium, wherein said adjustment means adjusts said distance from said recording head to said recording medium by a first lever provided for said recording apparatus, and said detection means for detecting said distance from said recording head to said recording medium comprises a second lever that presses against a portion of said first lever.

14. A recording apparatus according to claim 9 further comprising:

adjustment means for adjusting said distance from said recording head to said recording medium, wherein said adjustment means adjusts said distance from said recording head to said recording medium by a first lever provided for said carriage, and said detection means for detecting said distance from said recording head to said recording medium comprises a second lever that presses against a portion of said first lever.

15. A recording apparatus according to claim 9 further comprising:

adjustment means for adjusting said distance from said recording head to said recording medium, wherein said adjustment means adjusts said distance from said recording head to said recording medium by a lever provided for said recording apparatus, and said detection means optically detecting a state of said lever to detect said distance from said recording head to said recording medium.

16. A recording apparatus according to claim 9 further comprising:

adjustment means for adjusting said distance from said recording he ad to said recording medium, wherein said adjustment mean s adjusts said distance from said recording head to said recording medium by a lever provided for said carriage, and said detection means optically detects a state of said lever to detect said distance from said recording head to said recording medium.

17. A recording apparatus according to claim 9, wherein said recording head change the state of said ink by heating and discharging said ink in accordance with said change of said state.

18. A recording apparatus that uses a recording head for recording a data on a recording medium by discharging an ink, said recording apparatus comprising:

a carriage on which said recording head is mounted;

moving means for causing said carriage to reciprocate with respect to said recording medium with a forward directional relative movement and a rearward directional relative movement;

recording control means for controlling said recording head during a moving operation performed by said moving means to record said data on said recording medium;

mode selection means for selecting a recording mode corresponding to a distance from said recording head to said recording medium;

storage means for storing a correction value for correcting a deviation occurring in a recording operation between a forward moving operation of said carriage and a rearward moving operation of said carriage to correspond to said distance from said recording head to said recording medium;

selection means for selecting said given correction value from said storage means, said given correction value corresponding to said recording mode selected by said mode selection means; and head drive means for correcting a recording timing of said recording head in accordance with said correction value selected by said selection means and operating said recording head.

19. A recording apparatus according to claim 18 further comprising position detection means for detecting a position of said carriage in a relative moving direction, wherein said position detection means comprises a position scale disposed along a movement range to be covered by said carriage and a position detection device provided for said carriage.

20. A recording apparatus according to claim 19, wherein said position detection means magnetically detects the position of said carriage in said relative moving direction.

21. A recording apparatus according to claim 19, wherein said position detection means optically detects the position of said carriage in said relative moving direction.

22. A recording apparatus according to claim 18 further comprising adjustment means for adjusting the distance from said recording head to said recording medium.

23. A recording apparatus according to claim 22, wherein said adjustment means adjusts said distance from said recording head to said recording medium by using a lever provided for said recording apparatus.

24. A recording apparatus according to claim 22, wherein said adjustment means adjusts said distance from said recording head to said recording medium by a lever provided for said carriage.

25. A recording apparatus according to claim 18, wherein said head drive means corrects said recording timing in a single direction recording of said forward directional relative movement and said rearward directional relative movement of said carriage caused by said moving means.

26. A recording apparatus according to claim 18, wherein said mode selection means selects said recording mode by a switch provided for said recording apparatus.

27. A recording apparatus according to claim 18, wherein said recording head changes the state of said ink by heating and discharging said ink in accordance with said change of said state.

28. A recording method in which a recording head for recording a data on a recording medium by discharging an ink is mounted on a carriage and said recording head is operated during a moving operation in which said carriage is relatively reciprocated in a forward recording operation and a rearward recording operation with respect to said recording medium, said recording method comprising:

changing a setting of a distance from said recording head to said recording medium, a speed at which said carriage is relatively moved by said moving means and an ink discharge speed from said recording head;

a correction value determining step in which a correction value for correcting a deviation occurring in a recording operation between a forward moving operation of said carriage and a rearward moving operation of said carriage is determined to correspond to said changed setting; and a step in which a recording timing of said recording head is corrected in accordance with said correction value and said recording head is operated in accordance with said recording timing to record data on said recording medium.

29. A recording method according to claim 28, wherein said correction value is selected from a table stored to correspond to each of a plurality of modes.

30. A recording method according to claim 28, wherein said correction value is determined by calculations from each setting.

31. A recording method according to claim 28, wherein said recording timing is corrected for recording in only one of said forward operation and said rearward recording operation.

32. A recording method according to claim 28, wherein said recording head changes the state of said ink by heating and discharging said ink in accordance with said change of said state.

33. A recording apparatus comprising:

a carriage on which a plurality of recording means which record data on a recording medium by ejecting an ink and which are disposed in a predetermined direction can be mounted;

moving means for moving said carriage with respect to said recording medium in said predetermined direction in a relative moving operation with a relative movement and a speed;

recording control means for controlling said plural recording means during said relative moving operation performed by said moving means to record said data on said recording medium;

environmental condition detection means for detecting an environmental condition of said recording apparatus;

recording condition setting means for setting at least one of the speed of the relative movement of the carriage performed by said moving means and a driving condition of said recording means based on a result detected by said environmental condition detection means, said recording condition setting means varying the discharge speed of the ink elected by said recording means in accordance with the driving condition that has been set;

speed detection means for detecting the speed of said relative movement of the carriage performed by said moving means; and means for determining an operation timing of said plural recording means in accordance with a result of said speed detection performed by said speed detection means and driving condition of said recording means changed by said recording condition setting means.

34. A recording apparatus according to claim 33 further comprising:

detection means for detecting and which is mounted on said carriage and arranged to detect at least two detectable means for being detected and which said detectable means are disposed along a direction in which said moving means performs said relative moving operation, wherein said speed detection means detects the speed of said relative moving operation performed by said moving means from a result of said detection of said detectable means obtained by said detection means.

35. A recording apparatus according to claim 34, wherein said speed detection means measures a time taken for said carriage to move in a space between said two detectable means which are to be detected by said detection means to detect the speed of said relative moving operation of said carriage.

36. A recording apparatus according to claim 34, wherein said at least two detectable means which are to be detected, which are disposed along said direction in which said moving means performs said relative moving operation and said detection means mounted on said carriage enables a width of said recording medium in said relative moving direction to be detected.

37. A recording apparatus according to claim 33 further comprising:

at least two detectable means for being detected, which are disposed along said relative moving direction of said moving means;

at least two detection means for detecting said at least two detectable means, said detection means being mounted on said carriage, wherein said speed detection means detects the speed of said relative moving operation performed by said moving means from a result of said detection of said detectable means obtained by said detection means.

38. A recording apparatus according to claim 37, wherein said speed detection means detects said detectable means which are to be detected by said two detection means and measures a time taken for said carriage to move in a space between said detection means to detect a speed of said relative moving operation of said carriage.

39. A recording apparatus according to claim 33, wherein plural recording means has a plurality of discharge ports for discharging said ink and heat energy generating means for changing a state of said ink by heating and thereby discharging said ink through said discharge ports in accordance with said change of said state as to form an ink droplet which can be ejected.

40. A recording apparatus that uses a recording head for recording a data on a recording medium by discharging an ink, said recording apparatus comprising:

a carriage on which said recording head is mounted;

moving means for causing said carriage to reciprocate with respect to said recording medium with a forward directional relative movement and a rearward directional relative movement;

recording control means for controlling recording that operates said recording head during a moving operation performed by said moving means to record said data on said recording medium;

mode selection means for selecting a recording mode corresponding to a speed at which said carriage is relatively moved by said moving means;

storage means in which a correction value for correcting a deviation occurring in a recording operation between a forward moving operation of said carriage and a rearward moving operation of said carriage is stored to correspond to said speed at which said carriage is relatively moved by said moving means;

selection means for selecting a given said correction value from said storage means, said given said correction value corresponding to said recording mode selected by said mode selection means; and head drive means for correcting a recording timing of said recording head in accordance with said given said correction value selected by said selection means and operating said recording head.

41. A recording apparatus according to claim 40, wherein said head drive means corrects said recording timing in a single direction recording of said forward directional relative movement and said rearward directional relative movement of said carriage caused by said moving means.

42. A recording apparatus according to claim 40, wherein said mode selection means selects said recording mode by a switch provided for said recording apparatus.

43. A recording apparatus according to claim 40, wherein said recording head changes a state of said ink by heating and discharging said ink as a result of said change of said state.

44. A recording method using a recording head for recording a data on a recording medium by discharging an ink, comprising the steps of:

providing a carriage on which said recording head is mounted;

moving said carriage to reciprocate with respect to said recording medium with a forward directional relative movement and a rearward directional relative movement;

controlling said recording head during the moving step to record said data on said recording medium;

detecting a distance from said recording head to said recording medium, a speed at which said carriage is relatively moved by said moving means and an ink discharge speed from said recording head;

storing a correction value for correcting a deviation occurring in a recording operation between a forward moving operation of said carriage and a rearward moving operation of said carriage to correspond to a result of said detecting step;

selecting a given said correction value from said storage means, said given correction value corresponding to the result of detection performed by said detection means; and head drive means for correcting a recording timing of said recording head in accordance with said given correction value selected in said selecting step, and operating said recording head.

45. A recording method, comprising the steps of:

providing a carriage on which a plurality of recording means which record data on a recording medium by ejecting an ink and which are disposed in a predetermined direction can be mounted;

moving said carriage with respect to said recording medium in said predetermined direction in a relative moving operation with a relative movement and a speed;

controlling said plural recording means during said moving step to record said data on said recording medium;

detecting an environmental condition of said recording apparatus;

setting at least one of the speed of the relative movement of the carriage performed by said moving means and a driving condition of said recording means based on a result detected by said environmental condition detection means, said recording condition setting means varying the discharge speed of the ink ejected by said recording means in accordance with the driving condition that has been set;

detecting the speed of said relative movement of the carriage performed by said moving means; and determining an operation timing of said plural recording means in accordance with a result of said speed detection performed by said speed detection means and driving condition of said recording means changed by said recording condition setting means.

* * * * *

UNITED STATES PATENT AND TRADEMARK OFFICE

CERTIFICATE OF CORRECTION

PATENT NO. : 5,988,784

DATED : November 23, 1999

INVENTOR(S) : MAKOTO TAKEMURA ET AL.

It is certified that error appears in the above-identified patent and that said Letters Patent is hereby corrected as shown below:

COLUMN 4:

Line 6, "according" should read --according to--; and
Line 64, "sand" should read --and--.

COLUMN 5:

Line 42, "be" should be deleted; and
Line 60, "is" should be deleted; and
"a flow chart which illustrates" should read --flow charts which illustrate--.

COLUMN 7:

Line 50, "view" should read --views--.

COLUMN 10:

Line 30, "determined" should read --determine--.

COLUMN 11:

Line 36, "he" should read --the--.

COLUMN 12:

Line 29, "in" (first occurrence) should read --is--; and
Line 63, "have" should read --having--.

COLUMN 15:

Line 23, "(P.F)" should read --(P.F.)--.

COLUMN 19:

Line 30, "Although" should read --¶ Although--.

UNITED STATES PATENT AND TRADEMARK OFFICE

CERTIFICATE OF CORRECTION

PATENT NO. : 5,988,784

DATED : November 23, 1999

INVENTOR(S) : MAKOTO TAKEMURA ET AL.

It is certified that error appears in the above-identified patent and that said Letters Patent is hereby corrected as shown below:

COLUMN 21:

Line 48, "he ad" should read --head--; and
Line 49, "mean s" should read --means--.

COLUMN 24:

Line 37, "wherein" should read --wherein said--.

Signed and Sealed this

First Day of May, 2001

*Attest:*

Nicholas P. Godici

NICHOLAS P. GODICI

*Attesting Officer*

*Acting Director of the United States Patent and Trademark Office*